US009359713B2

(12) United States Patent
Kang

(10) Patent No.: US 9,359,713 B2
(45) Date of Patent: Jun. 7, 2016

(54) DRYING APPARATUS, WASHING MACHINE HAVING THE SAME AND METHOD OF CONTROLLING THE DRYING APPARATUS

(71) Applicant: Samsung Electronics Co., Ltd., Suwon-si (KR)

(72) Inventor: Min Hee Kang, Busan (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 172 days.

(21) Appl. No.: 14/312,831

(22) Filed: Jun. 24, 2014

(65) Prior Publication Data

US 2015/0089832 A1 Apr. 2, 2015

(30) Foreign Application Priority Data

Oct. 2, 2013 (KR) ..... 10-2013-0117757

(51) Int. Cl.

*D06F 58/22* (2006.01)
*D06F 58/28* (2006.01)
*D06F 29/00* (2006.01)
(Continued)

(52) U.S. Cl.

CPC ..... *D06F 58/28* (2013.01); *D06F 25/00* (2013.01); *D06F 29/005* (2013.01); *D06F 35/006* (2013.01); *D06F 2058/2803* (2013.01); *D06F 2058/2877* (2013.01); *D06F 2204/065* (2013.01)

(58) Field of Classification Search

CPC ..... F26B 19/00; F26B 21/00; D06F 58/00; D06F 58/20; D06F 58/22
USPC ..... 34/381, 595, 610; 68/5 C, 5 R, 19, 20; 8/139, 149, 159
See application file for complete search history.

(56) References Cited

U.S. PATENT DOCUMENTS 3,805,404 A * 4/1974 Gould ..... D06F 58/04 34/596
4,891,892 A * 1/1990 Narang ..... D06F 39/00 34/606
7,251,906 B2 * 8/2007 Kajihara ..... D06F 58/22 34/474

(Continued)

FOREIGN PATENT DOCUMENTS

GB 2484678 4/2012
JP 7-90077 10/1995

(Continued)

OTHER PUBLICATIONS

European Search Report issued Feb. 13, 2015 in corresponding European Patent Application No. 14181134.9.

*Primary Examiner* — Stephen M Gravini
(74) *Attorney, Agent, or Firm* — Staas & Halsey LLP

(57) ABSTRACT

A drying apparatus that is capable of effectively removing foreign substances, such as dead mite bodies and dust adhered to bedding, a washing machine having the drying apparatus, and a method of controlling the drying apparatus. When bedding having a large volume, such as a blanket or a cover, is washed, a bedding-dusting operation using rotation of a drum and high-temperature hot air is performed before and after a bedding washing course is performed, so that foreign substances, such as dead mite bodies or dust, are dusted off bedding and the effects of washing bedding can be improved. In addition, a section in which the bedding-dusting operation is to be performed, is automatically or manually selected as before bedding washing or after bedding washing so that various operations can be performed and the effects of washing bedding can be improved.

20 Claims, 15 Drawing Sheets

(51) Int. Cl.
*D06F 25/00* (2006.01)
*D06F 35/00* (2006.01)

(56) References Cited

U.S. PATENT DOCUMENTS

| | | | | |
|---|---|---|---|---|
| 8,375,599 | B2 * | 2/2013 | Dey | D06F 58/28 34/595 |
| 8,418,376 | B2 * | 4/2013 | Steffens | D06F 58/206 34/130 |
| 8,695,228 | B2 * | 4/2014 | Lee | D06F 58/20 34/595 |
| 8,800,165 | B2 * | 8/2014 | Kwon | D06F 25/00 134/18 |
| 9,133,575 | B2 * | 9/2015 | Hong | D06F 25/00 |
| 9,194,073 | B2 * | 11/2015 | Kwon | D06F 58/22 |
| 2003/0233854 | A1 * | 12/2003 | Matsuda | D06F 25/00 68/16 |
| 2006/0150689 | A1 * | 7/2006 | Kim | D06F 29/00 68/236 |
| 2010/0107703 | A1 * | 5/2010 | Hisano | D06F 25/00 68/20 |
| 2015/0089832 | A1 * | 4/2015 | Kang | D06F 25/00 34/499 |
| 2015/0191863 | A1 * | 7/2015 | Kim | D06F 58/04 34/493 |

FOREIGN PATENT DOCUMENTS

| | | | | |
|---|---|---|---|---|
| JP | 2002-336593 | | 11/2002 | |
| JP | 2004-159756 | | 6/2004 | |
| JP | 2004-267334 | | 9/2004 | |
| JP | 2008-289820 | | 12/2008 | |
| KR | EP 1577433 | A2 * | 9/2005 | D06F 25/00 |
| KR | 10-2008-0002479 | | 1/2008 | |
| KR | 101297991 | B1 * | 8/2013 | |
| KR | DE 102005018044 | B4 * | 10/2013 | D06F 25/00 |
| KR | 20150039630 | A * | 4/2015 | D06F 25/00 |
| KR | EP 2857576 | A1 * | 4/2015 | D06F 25/00 |
| TR | WO 2014044533 | A3 * | 3/2014 | D06F 58/28 |

* cited by examiner

DRYING APPARATUS, WASHING MACHINE HAVING THE SAME AND METHOD OF CONTROLLING THE DRYING APPARATUS

CROSS-REFERENCE TO RELATED APPLICATIONS

This application claims the benefit of Korean Patent Application No. 10-2013-117757, filed on Oct. 2, 2013 in the Korean Intellectual Property Office, the disclosure of which is incorporated herein by reference.

BACKGROUND

1. Field

Embodiments of the present disclosure relate to a drying apparatus that improves the effects of washing bedding having a large volume, a washing machine having the same, and a method of controlling the drying apparatus.

2. Description of the Related Art

In general, a drying apparatus is an apparatus that supplies high-temperature air (hot air) heated by a hot air heater into a drum so as to dry laundry while the drum in which clothes to be dried (hereinafter, referred to as laundry) are accommodated, is rotated. A drying and washing machine (generally, a drum washing machine) having the drying apparatus has been introduced, and only a drying operation is performed, or the drying operation is performed in connection with a washing operation.

Since a washing machine having the drying apparatus dries laundry using high-temperature hot air, various smells or mold in laundry can be removed. However, since bedding, such as a blanket or cover, has a large volume and a large size, an internal space of the drum is fully filled with only one blanket, and even though the size of the blanket is small, washing is performed with folded parts. Thus, contamination or smell immersed in bedding may be removed. However, foreign substances, such as dead mite bodies or dust in bedding, agglomerate in folded parts of the blanket with moisture or between blankets. Also, since the drum is fully filled with bedding, the drum is rotated with little movement, and bedding is not widely spread out so that foreign substances, such as dead mite bodies or dust, are not removed from bedding and remain until washing is completed.

SUMMARY

Therefore, it is an aspect of the present disclosure to provide a drying apparatus that is capable of effectively removing foreign substances, such as dead mite bodies and dust adhered to bedding, a washing machine having the drying apparatus, and a method of controlling the drying apparatus.

Additional aspects of the disclosure will be set forth in part in the description which follows and, in part, will be apparent from the description, or may be learned by practice of the disclosure.

In accordance with one aspect of the present disclosure, there is provided a method of controlling a drying apparatus including a drum in which laundry including bedding is accommodated, a motor that rotates the drum, and a blower fan and a heater that supply hot air into the drum, the method including: determining whether a current course is a bedding washing course; if it is determined that the current course is the bedding washing course, performing a bedding washing operation of removing contamination of the bedding using water and detergent; and performing a bedding-dusting operation of removing foreign substances of the bedding using rotation of the drum and the hot air, wherein the bedding-dusting operation is performed before or after the bedding washing operation is performed.

The bedding-dusting operation may be performed before the water is supplied for the bedding washing operation.

The method may further include performing a drying operation of drying bedding that is wet after the bedding washing operation is performed, using rotation of the drum and the hot air, wherein the bedding-dusting operation may be performed after the drying operation is performed.

The drying operation may include rotating the drum at a predetermined rotation speed.

The bedding-dusting operation may control an operation of the motor so as to change the rotation speed of the drum according to predetermined intervals of time, unlike in the drying operation.

The bedding-dusting operation may include a plurality of sections in which the rotation speed of the drum is changed according to the predetermined intervals of time, and the plurality of sections may include a first section in which the motor is driven at first revolutions per minute (rpm) and a first operation rate operation rate to stir the drum right and left, a second section in which the motor is driven at a second rpm and a second operation rate to stir the drum right and left, and a third section in which the motor is driven at a third rpm and a third operation rate to stir the drum right and left.

The first section may include operations: (a) rotating the drum in one direction for a fourth time; (b) after rotating the drum in the one direction, stopping the drum for a fifth time; (c) if the fifth time elapses, rotating the drum in an opposite direction for the fourth time; and (d) after rotating the drum in the opposite direction, stopping the drum for the fifth time, wherein performing a right and left stirring operation of the drum including the operations (a) to (d) may be performed for a predetermined first time so that the bedding is capable of being uniformly adhered to inner walls of the drum.

The second section may include operations: (e) rotating the drum in one direction for a sixth time; (f) after rotating the drum in the one direction, stopping the drum for a seventh time; (g) if the seventh time elapses, rotating the drum in an opposite direction for the sixth time; and (h) after rotating the drum in the opposite direction, stopping the drum for the seventh time, wherein performing a right and left stirring operation of the drum including the operations (e) to (h) may be performed for a predetermined second time so that foreign substances including mites or dust adhered to the bedding are capable of being removed.

The third section may include operations: (i) rotating the drum in one direction for an eighth time; (j) after rotating the drum in the one direction, stopping the drum for a ninth time; (k) if the ninth time elapses, rotating the drum in an opposite direction for the eighth time; and (l) after rotating the drum in the opposite direction, stopping the drum for the ninth time, wherein performing a right and left stirring operation of the drum including the operations (i) to (l) may be performed for a predetermined third time so that the bedding is capable of being uniformly distributed throughout the drum.

A motor rpm of the first section may be greater than a motor rpm of the second section, and a motor rpm of the second section may be greater than a motor rpm of the third section.

The first through third sections may further include changing the motor rpm when the drum is stirred right and left.

A motor off time of the first section may be shorter than a motor off time of the second section, and a motor off time of the second section may be shorter than a motor off time of the third section.

The first through third sections may further include changing a motor driving time or a motor stopping time when the drum is stirred right and left.

In accordance with another aspect of the present disclosure, there is provided a method of controlling a drying apparatus including a drum in which laundry including bedding is accommodated, a motor that rotates the drum, and a blower fan and a heater that supply hot air into the drum, the method including: if a current course is a bedding washing course, performing a bedding washing course including a washing operation of removing contamination of the bedding using water and detergent and a drying operation of drying the bedding that is wet in water, using rotation of the drum and hot air; and performing a bedding-dusting operation of removing foreign substances of the bedding that is not wet in water using rotation of the drum and the hot air, wherein the bedding-dusting operation may be performed before or after the bedding washing course is performed.

In accordance with still another aspect of the present disclosure, there is provided a drying apparatus including: a drum in which laundry including bedding is accommodated; a motor that rotates the drum; a blower fan that causes air to be introduced into the drum; a heater that heats air introduced into the drum; an input unit that selects a bedding washing course for washing of the bedding; and a controller, if the bedding washing course is selected, performing a bedding-dusting operation of removing foreign substances of the bedding by operating the motor, the blower fan, and the heater before water is supplied into the drum and performing a bedding washing operation of removing contamination of the bedding by supplying water into the drum after the bedding-dusting operation is performed.

The controller may further perform a drying operation of drying wet bedding after the bedding washing operation is performed.

The controller may additionally perform the bedding-dusting operation after the drying operation is performed.

When the drying operation is performed, the controller may drive the motor at predetermined revolutions per minute (rpm) and a predetermined operation rate so as to uniformly maintain a rotation speed of the drum.

When the bedding-dusting operation is performed, the controller may drive the motor at various rpms and various operation rates so as to change a rotation speed of the drum.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
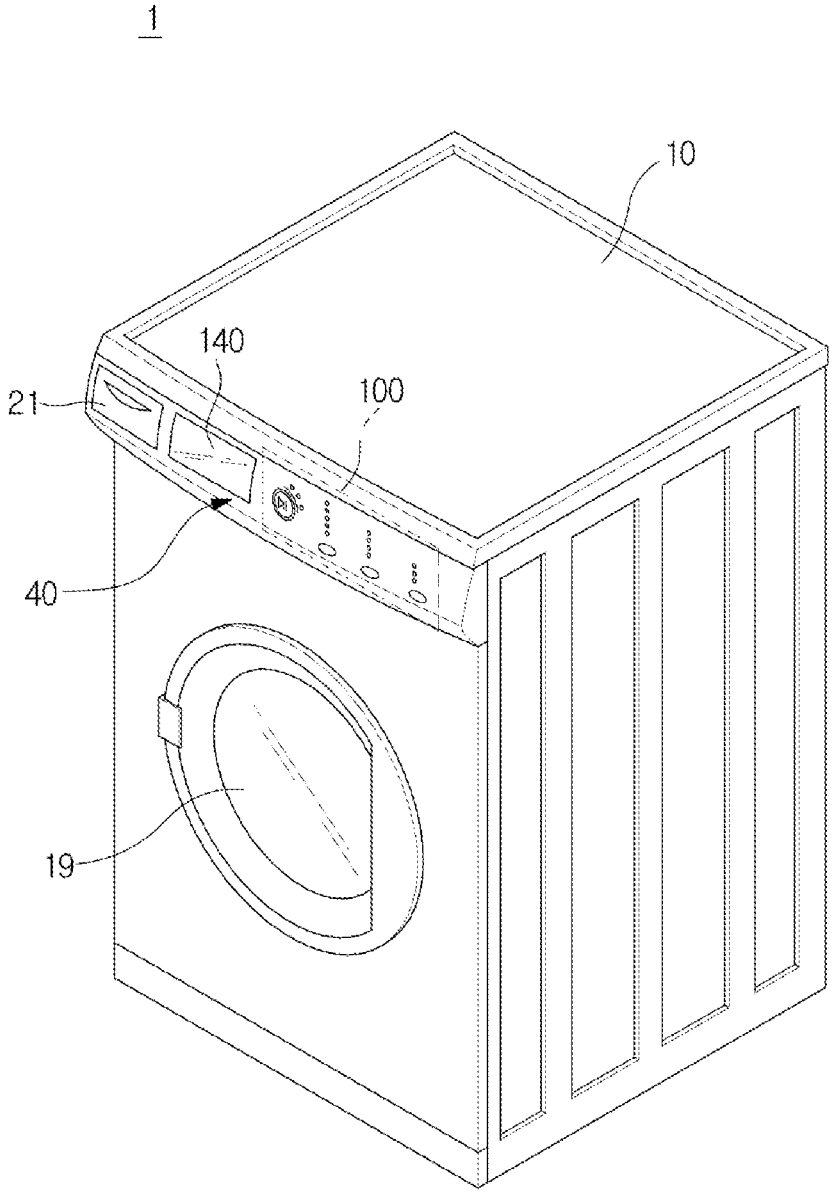
FIG. 1 is a perspective view illustrating an exterior of a washing machine having a drying apparatus in accordance with an embodiment of the present disclosure.

Reference will now be made in detail to the embodiments of the present disclosure, examples of which are illustrated in the accompanying drawings, wherein like reference numerals refer to like elements throughout.

Figure 2:
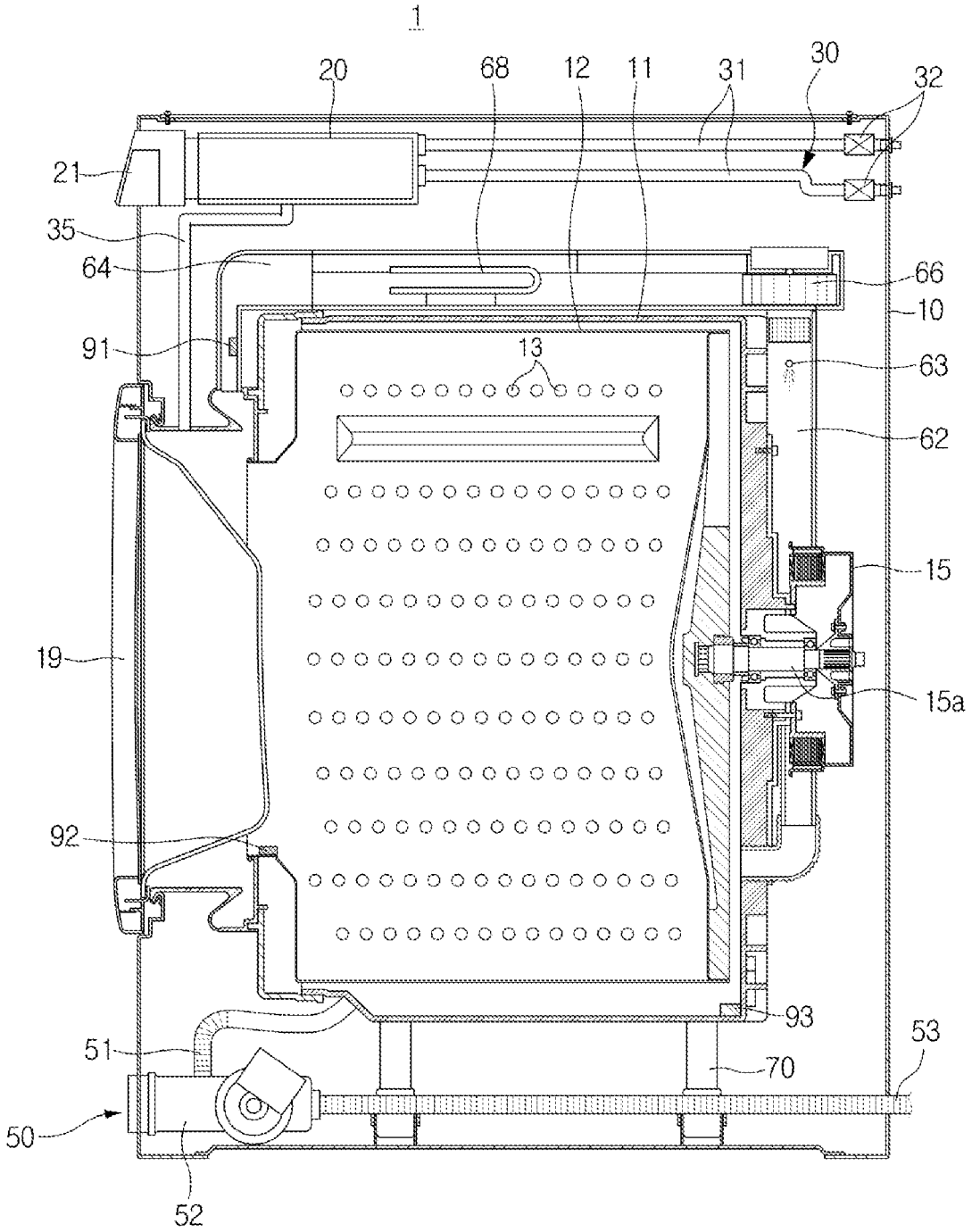
FIG. 2 is a cross-sectional view illustrating a configuration of the washing machine illustrated in FIG. 1.
Figure 3:
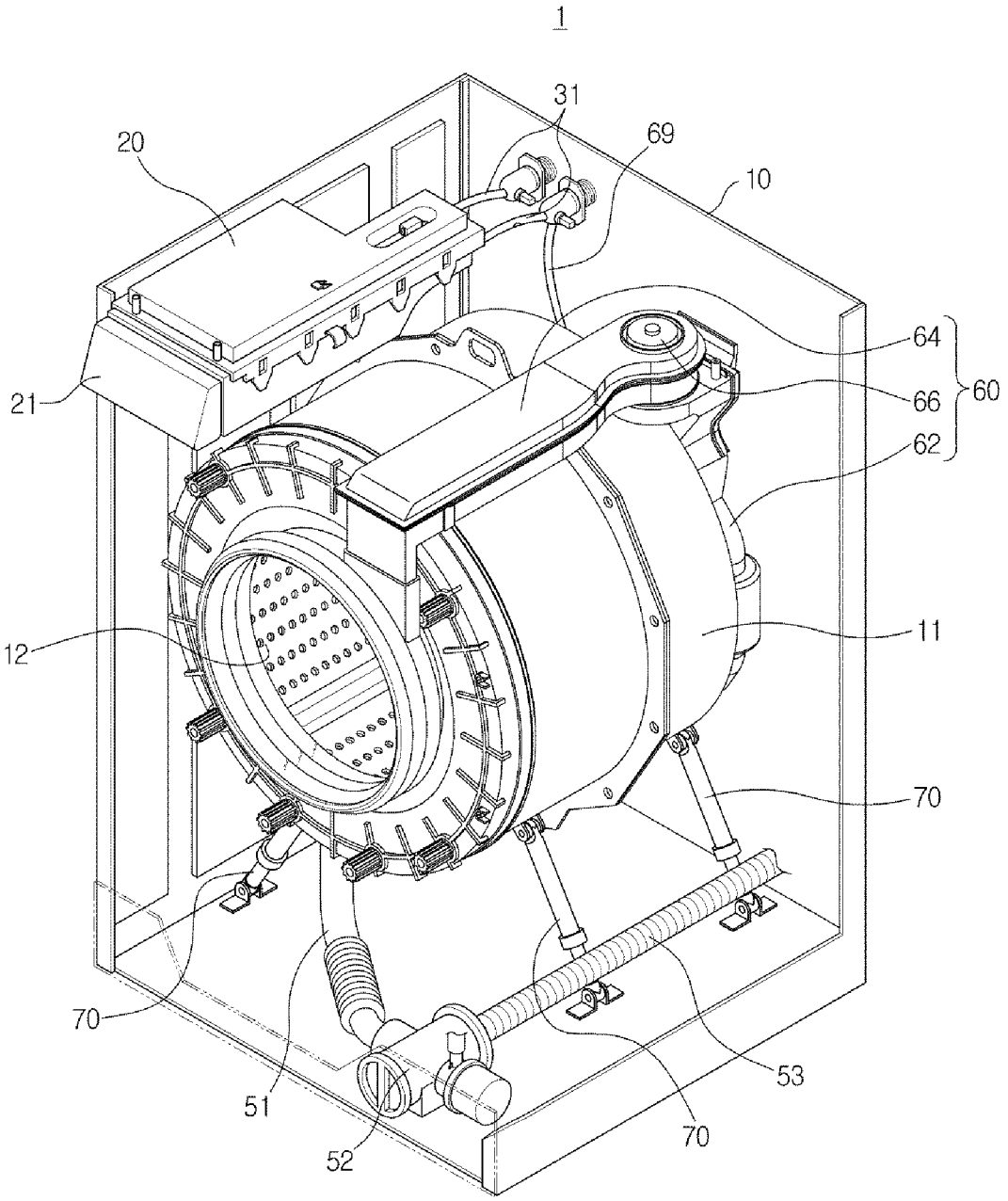
FIG. 3 is an excerpt perspective view of portions of the configuration of FIG. 2.

FIG. 1 is a perspective view illustrating an exterior of a washing machine having a drying apparatus in accordance with an embodiment of the present disclosure, FIG. 2 is a cross-sectional view illustrating a configuration of the washing machine illustrated in FIG. 1, and FIG. 3 is an excerpt perspective view of portions of the configuration of FIG. 2.

Referring to FIGS. 1 through 3, a washing machine 1 in accordance with an embodiment of the present disclosure includes a body 10 that has an approximately box shape and constitutes an exterior, a tub 11 which is installed in the body 10 and in which water (washing water or rinsing water) is stored, and a cylindrical drum 12 which is rotatably installed in the tub 11 and in which a plurality of holes 13 are formed.

A motor 15 that is a driving unit for rotating a rotation shaft 15*a* connected to the drum 12 so as to perform a washing operation, a rinsing operation, a dehydration operation, and a drying operation, is installed at an outer side of a rear side of the tub 11.

A universal motor including a field coil and an armature or a brushless direct current (BLDC) motor including a permanent magnet and an electric magnet is generally used as the motor 15, and any type of motor that may be applied to the small and medium drum 12 may be used as the motor 15.

Also, a door 19 is installed at a front side of the body 10 so as to put laundry into the drum 12 or to take out laundry from an internal space of the drum 12.

A detergent supply unit 20 for supplying detergent, for example, synthetic detergent or natural soap detergent, and a water supply unit 30 for supplying water (washing water or rinsing water) into the tub 11 are installed above the tub 11.

An internal space of the detergent supply unit 20 is partitioned off into a plurality of spaces, and the detergent supply unit 20 is installed at the front side of the body 10 so that a user can easily supply detergent and a fabric conditioner into each of the plurality of spaces.

Also, the water supply unit 30 includes water supply pipes 31 that connect a space between an external water supply pipe and the detergent supply unit 20 so as to supply water (washing water or rinsing water) into the tub 11, water supply valves 32 that are installed in a midway point of the water supply pipe 31 and control a supply of water, and a connection pipe 35 that connects a space between the detergent supply unit 20 and the tub 11. This configuration causes water supplied into the tub 11 to pass through the detergent supply unit 20 so that detergent inside the detergent supply unit 20 can be supplied into the tub 11 together with water.

Also, a control panel 40 on which various buttons for controlling the washing machine 1 and displays are disposed, is provided at an upper part of the front side of the body 10. An input unit 100 on which various buttons via which a user's manipulation instructions are input, are provided so as to control an operation of the washing machine 1, and a display unit 140 on which an operating state of the washing machine 1 and the user's manipulation state are displayed, are disposed on the control panel 40.

A detergent supply portion 21 that is connected to the detergent supply unit 20 and supplies the detergent and the fabric conditioner, is disposed at one side of the control panel 40.

The washing machine 1 in accordance with an embodiment of the present disclosure further includes a drainage unit 50 that discharges water in the tub 11 toward an outer side of the body 10. The drainage unit 50 includes a first drainage pipe 51 that is connected to a lower part of the tub 11 so as to discharge water in the tub 11 to the outside, a drainage pump 52 that is installed at the first drainage pipe 51, and a second drainage pipe 53 that is connected to an outlet of the drainage pump 52.

The washing machine 1 in accordance with an embodiment of the present disclosure further includes a drying apparatus 60 for drying laundry in the drum 12. The drying apparatus 60 includes a condensation duct 62 that condenses moisture in the air introduced from the drum 12, a drying duct 64 that heats and dries air introduced from the condensation duct 62, and a blower fan 66 that is disposed between the condensation duct 62 and the drying duct 64 and forms a flow of air so that air introduced into the condensation duct 62 can flow into the drum 12 via the drying duct 64. A heater 68 for heating air in the drying duct 64 is built in the drying duct 64, and a water supply nozzle 63 is disposed at the condensation duct 62 and supplies condensed water (cold water) into the condensation duct 62 so that, when high-temperature humid air generated when laundry is dried passes through the condensation duct 62, moisture can be condensed and removed. The water supply nozzle 63 is connected to a condensed water supply pipe 69 that supplies condensed water, and the condensed water supply pipe 69 is connected to the water supply valves 32.

Thus, the condensed water supplied via the water supply valves 32 passes through the condensed water supply pipe 69, is sprayed from the water supply nozzle 63, and flows along an inner side of the condensation duct 62 so that contact between the high-temperature humid air that rises from the bottom and the condensed water increases and the effects of condensation can be improved.

The washing machine 1 in accordance with an embodiment of the present disclosure further includes a damper 70 that is disposed below the tub 11 and movably supports the tub 11 so as to reduce vibration that occurs when the washing machine 1 operates.

The washing machine 1 in accordance with an embodiment of the present disclosure further includes a temperature sensor 91 that is disposed at an upper part of a front side of the drying duct 64 and detects the temperature of air introduced into the drum 12, i.e., the temperature of an inlet of the drum 12, and a humidity sensor 92 that is disposed at a bottom end of a front side of the drum 12, contacts laundry that rotates according to rotation of the drum 12, measures sensing values of electrical signals that vary according to a content of moisture contained in laundry, and detects vapor concentration of laundry. A plate bar-shaped touch sensor or a capacitive sensor may be used as the humidity sensor 92 so as to directly measure and to detect resistance when laundry contacts the drum 12.

Also, a water level sensor 93 is installed in an internal space of a lower part of the tub 11 and detects a frequency that varies according to a water level so as to detect the amount (level) of water in the tub 11.

Figure 4:
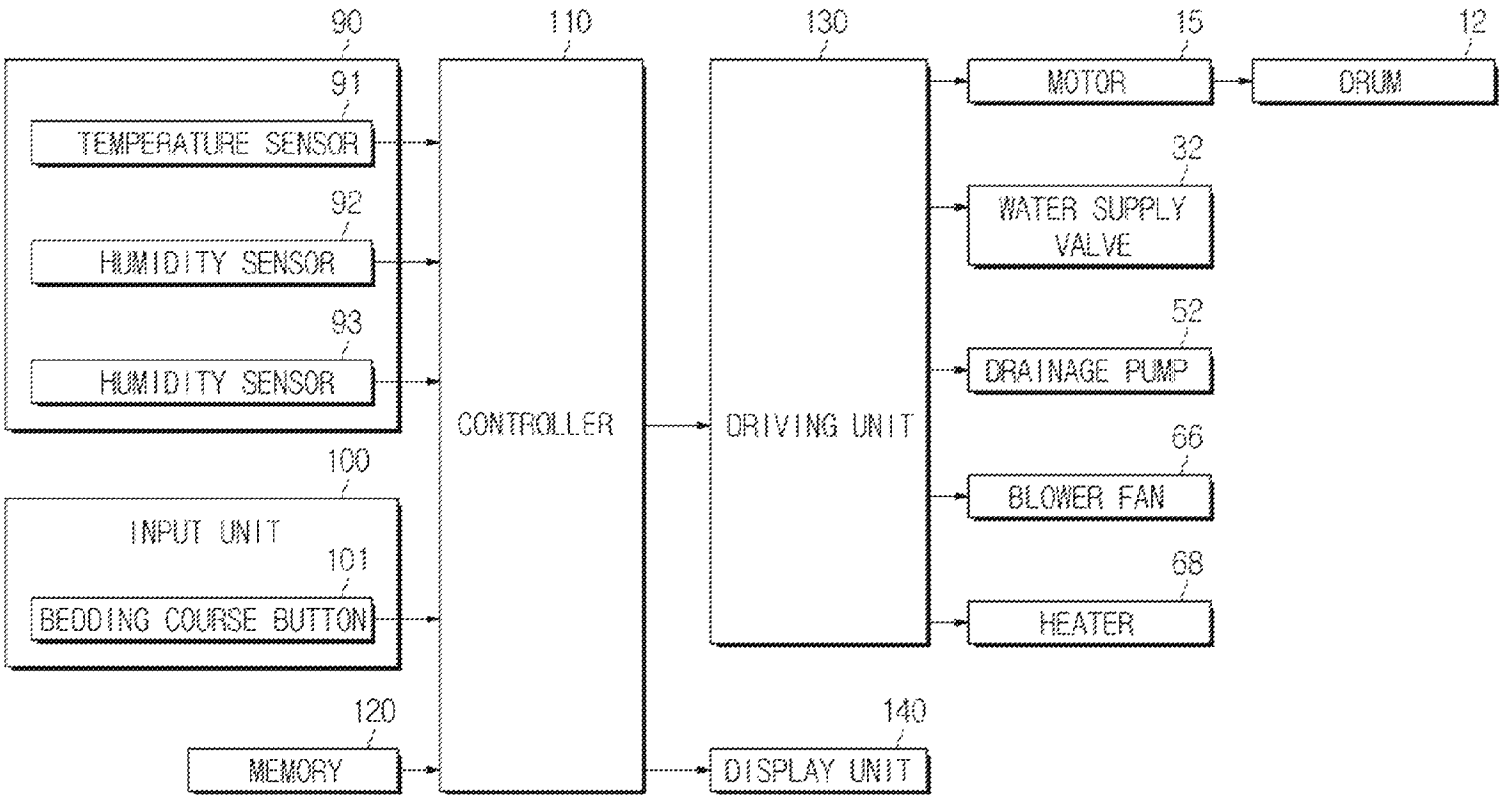
FIG. 4 is a block diagram illustrating a control configuration of the washing machine having a drying apparatus of FIG. 1.

FIG. 4 is a block diagram illustrating a control configuration of the washing machine having a drying apparatus of FIG. 1. The washing machine 1 that may perform both a washing operation and a drying operation will be described below.

Referring to FIG. 4, the washing machine 1 in accordance with an embodiment of the present disclosure further includes a sensor unit 90, the input unit 100, a controller 110, a memory 120, a driving unit 130, and a display unit 140.

The sensor unit 90 includes various sensors installed at the washing machine 1, such as the temperature sensor 91 that is disposed at the upper part of the front side of the drying duct 64 and detects the temperature of air introduced into the drum 12, i.e., the temperature of the inlet of the drum 12, the humidity sensor 92 that is disposed at the bottom end of the front side of the drum 12 and detects vapor concentration of laundry, and the water level sensor 93 that is installed in the internal space of the lower part of the tub 11 and detects the amount (level) of water in the tub 11.

A method of detecting vapor concentration of laundry may include a method of detecting vapor concentration of laundry directly using the humidity sensor 92, a method of detecting vapor concentration of laundry by measuring a temperature rise using a sensor disposed at a rear side of the washing machine 1, or a method of detecting vapor concentration of laundry by directly measuring resistance generated when laundry contacts the drum 12 by attaching the capacitive sensor to the drum 12.

The input unit 100 is used to input instructions for performing the washing operation, the rinsing operation, the dehydration operation, and the drying operation of the washing machine 1 according to a user's manipulation. The input unit 100 may include a key, a button, a switch, a touch pad, or the like and includes all units that generate predetermined input data according to manipulation, such as pressing, contact, pressurization, or rotation.

Also, the input unit 100 includes a plurality of buttons for inputting the user's instructions regarding an operation of the washing machine 1, for example, power, reservation, washing water temperature, soaking, washing, rinsing, dehydration, detergent type, and the like. The plurality of buttons include a course selection button for selecting a washing course, i.e., a plurality of washing courses, such as a standard course, a wool course, a bedding course, and the like, according to the type of laundry put into the washing machine 1.

The course selection button disposed on the input unit 100 includes a bedding course button 101 for selecting a bedding washing course (a blanket washing course) in which bedding having a large volume, such as a blanket or a cover, is washed.

When bedding having a large volume, such as a blanket or a cover, is washed, the bedding course button 101 is disposed to select a section in which a bedding-dusting operation is performed so as to dust foreign substances, such as dead mite bodies or dust, from bedding using rotation and hot air of the drum 12 before and after the bedding washing course is performed.

The user may manipulate the bedding course button 101 to select the section in which the bedding-dusting operation is performed, so that the bedding-dusting operation can be performed before the bedding washing course is performed, or both before and after the bedding washing course is performed, or after the bedding washing course is performed.

This will now be described in more detail.

If the user manipulates the bedding course button 101, a first bedding washing course in which the bedding-dusting operation is performed before bedding is washed, is set as a default value. This means that, even when the user does not additionally select the bedding-dusting operation, it is automatically set that the bedding-dusting operation is performed before the bedding washing course is performed.

If, in a state in which the first bedding washing course is set, the user manipulates the bedding course button 101 again, a washing mode is changed into a second bedding washing course in which the bedding-dusting operation is performed both before and after bedding is washed. This means that, even when the user does not additionally select the bedding-dusting operation, it is set that the bedding-dusting operation is performed before and after the bedding washing course is performed. The second bedding washing course is a mode that may be manually selected by the user as needed.

If, in a state in which the second bedding washing course is set, the user manipulates the bedding course button 101 again, a washing mode is changed into a third bedding washing course in which the bedding-dusting operation is performed after bedding is washed. This means that, even when the user does not additionally select the bedding-dusting operation, it is set that the bedding-dusting operation is performed after the bedding washing course is performed. The third bedding washing course is a mode that may be manually selected by the user as needed, like in the second bedding washing course.

In this way, the user can select automatically or manually the first through third bedding washing courses by manipulating the bedding course button 101.

Subsequently, if the user manipulates the bedding course button 101 again, the washing mode is changed into the first bedding washing course set as the default value.

In an embodiment of the present disclosure, a method of selecting the first through third bedding washing courses in which the bedding-dusting operation is performed before, before and after, and after the bedding washing course is performed, through the user's manipulation of the bedding course button 101 has been described. However, a fourth bedding washing course (that is the same washing mode as a current blanket washing course) in which no bedding-dusting operation is performed and only a bedding washing course is performed, may be selected. In this case, as the user manipulates the bedding course button 101, the washing mode is changed into the second bedding washing course and the third bedding washing course from the first bedding washing course set as the default value. Subsequently, if the user manipulates the bedding course button 101 again, the washing mode may be changed directly into the fourth bedding washing course without passing through the first bedding washing course.

The current blanket washing course includes a washing operation of removing contamination or smell immersed in bedding using water and detergent and a drying operation of drying bedding that is wet after being washed, using rotation of the drum 12 and high-temperature hot air.

On the other hand, the bedding washing course according to the present disclosure additionally includes a bedding-dusting operation of dusting foreign substances, such as dead mite bodies or dust adhered to bedding that is not wet, using rotation of the drum 12 and high-temperature hot air, as well as the current blanket washing course including the washing operation of removing contamination or smell immersed in bedding using water and detergent and the drying operation of drying bedding that is wet after being washed, using rotation of the drum 12 and high-temperature hot air. Thus, the bedding-dusting operation is performed before or after the current blanket washing course is performed so that foreign substances, such as dead mite bodies or dust on bedding, can be effectively removed and inconveniences that the user should dust bedding with his/her hands after taking out dried bedding from the internal space of the drum 12, can be eliminated.

The controller 110 is a microcomputer that controls an overall operation of the washing machine 1, such as washing and rinsing, dehydration, drying, and bedding washing (blanket washing), according to operation information input from the input unit 100. The controller 110 sets a target washing water level and a target rinsing water level, target revolutions per minute (rpm) and a motor operation rate (motor on-off time), and a washing time and a rinsing time according to the weight (load amount) of laundry in the selected washing course.

Also, the controller 110 performs a bedding-dusting operation of effectively removing foreign substances, such as dead mite bodies or dust, from bedding using rotation of the drum 12 and hot air when bedding is washed.

The bedding-dusting operation includes a plurality of sections having various rpms and operation rates of the drum 12 so as to improve the effects of bedding-dusting. The plurality of sections include a first section (a spreading section) in which bedding is adhered to the drum 12 so as to be uniformly dusted while a space is formed in the center of bedding using a head drop and a centrifugal force of the drum 12, a second section (a concentrated-dusting section) in which foreign substances, such as dead mite bodies or dust adhered to bedding that is adhered to the drum 12 and is uniformly spread in the first section, are intensely dusted, and a third section (a balance section) in which bedding from which foreign substances, such as dead mite bodies or dust, are removed in the second section, is uniformly arranged.

In the first section, the motor 15 is driven at a first rpm (about 100 rpm) and an operation rate (30 seconds on/2 seconds off), the drum 12 is stirred right and left, bedding is widely spread, and a space is formed in the center of bedding so that bedding can be uniformly spread to be adhered to the drum 12. The first section is performed for a first time (about five minutes).

In the second section, the motor 15 is driven at a second rpm (about 60 rpm) and an operation rate (30 seconds on/4 seconds off), and the drum 12 is stirred right and left so that foreign substances, such as dead mite bodies or dust, can be intensely dusted from bedding adhered to inner walls of the drum 12. The second section is performed for a second time (about ten minutes).

In the third section, the motor 15 is driven at a third rpm (about 40 rpm) and an operation rate (10 seconds on/20 seconds off), and the drum 12 is stirred right and left so that bedding from which foreign substances, such as dead mite bodies or dust, are removed, can be uniformly arranged. The third section is performed for a third time (about five minutes).

Also, the controller 110 may perform the bedding-dusting operation before the bedding washing course is performed, before and after the bedding washing course is performed, or after the bedding washing course is performed, according to the user's manipulation.

The bedding-dusting operation performed before the bedding washing course is performed, is a pre-wash concept before bedding is washed with water and is an operation in which foreign substances, such as dead mite bodies or dust, are previously dusted from bedding using rotation of the drum 12 and hot air.

On the other hand, the bedding-dusting operation performed after the bedding washing course is performed, is a post-treatment concept after water washing and drying of bedding is completed and is an operation in which foreign substances, such as dead mite bodies or dust, are dusted from bedding using rotation of the drum 12 and hot air, and inconveniences that the user should dust bedding with his/her hands after taking out dried bedding from the internal space of the drum 12 are eliminated.

Also, the controller 110 may selectively perform the first through third sections of the bedding-dusting operation depending on whether the bedding-dusting operation is performed before or after the bedding washing course is performed. The controller 110 may also change times, i.e., first through third times, in which the first through third sections are performed. This means that an optimum algorithm may be designed depending on whether the bedding-dusting operation is performed before the bedding washing course is performed, before and after the bedding washing course is performed, or after the bedding washing course is performed.

Control data for controlling the operation of the washing machine 1, reference data used while the operation of the washing machine 1 is controlled, operating data that is generated while the washing machine 1 performs a predetermined operation, setting information, such as setting data input by the input unit 100 so that the washing machine 1 can perform a predetermined operation, usage information including the number of times at which the washing machine 1 performs a particular operation and information regarding a model of the washing machine 1, and failure information including a cause of malfunction or a position of malfunction when the washing machine 1 malfunctions, may be stored in the memory 120.

The driving unit 130 drives the motor 15, the water supply valves 32, the drainage pump 52, the blower fan 66, and the heater 68 relating to the operation of the washing machine 1 according to driving control signals of the controller 110.

The motor 15 is a driving unit that rotates the rotation shaft 15*a* connected to the drum 12 so as to perform a bedding washing mode. The motor 15 varies a mechanical force (a rotation speed of the drum 12) according to a time at which the bedding-dusting operation is performed.

The blower fan 66 is a unit that causes high-temperature air (hot air) to be introduced into the drum 12 so as to perform the bedding washing mode.

The display unit 140 is disposed on the control panel 40, displays an operating state of the washing machine 1 according to display control signals of the controller 110, recognizes input information through a user interface, and displays a user's manipulation state.

Hereinafter, operations and effects of a drying apparatus, a washing machine having the same, and a method of controlling the drying apparatus in accordance with an embodiment of the present disclosure will be described.

When bedding having a large volume, such as a blanket or a cover, is washed, the user wants a bedding care concept of washing in which not only contamination or smell (for example, damp smell) immersed in bedding can be removed but also foreign substances, such as dead mite bodies or dust adhered to bedding can be removed. Thus, a bedding care concept of washing course that may satisfy the user's needs will be described with reference to FIGS. 5 through 9.

First, a case that a bedding-dusting operation is performed before a bedding washing operation is performed, will be described with reference to FIG. 5.

Figure 5:
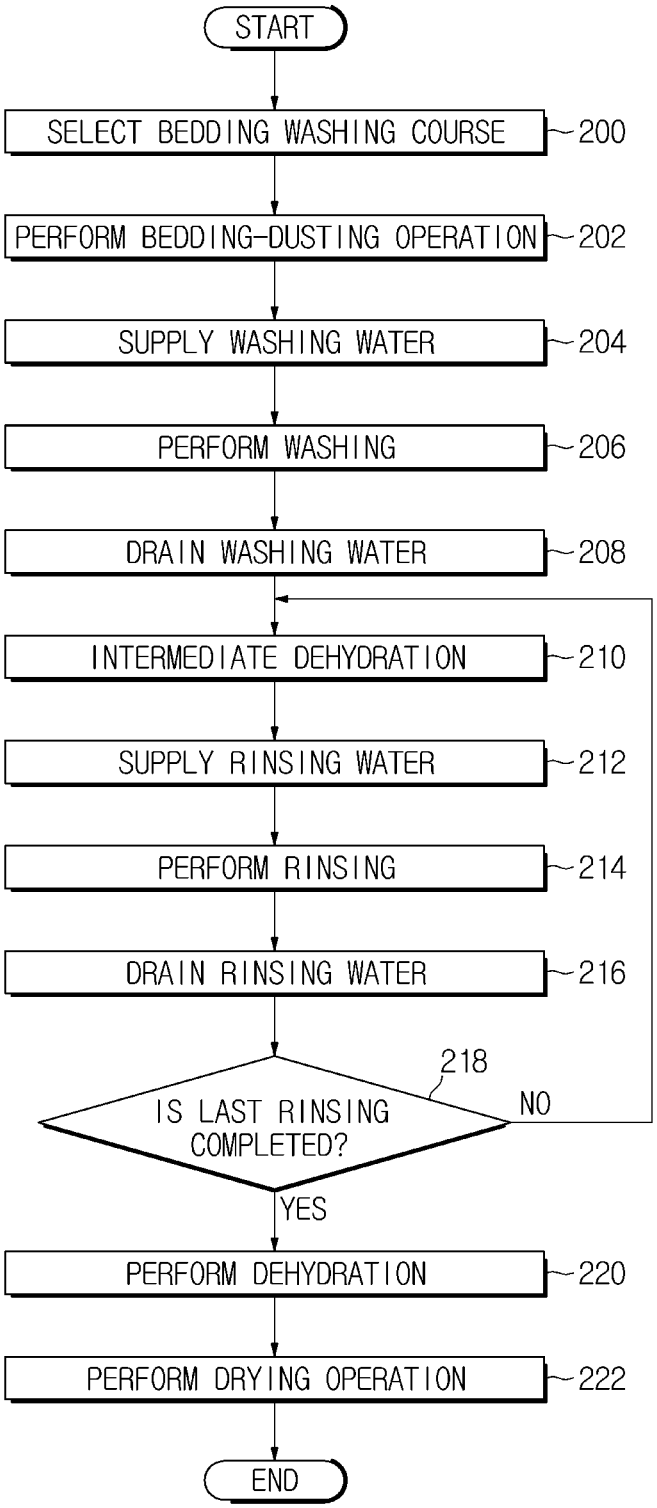
FIG. 5 is an operational flowchart illustrating a first control algorithm for washing bedding using the washing machine having a drying apparatus of FIG. 1.

FIG. 5 is an operational flowchart illustrating a first control algorithm for washing bedding using the washing machine having a drying apparatus of FIG. 1, wherein the first control algorithm is an algorithm in which foreign substances, such as dead mite bodies or dust in bedding, can be effectively removed.

Referring to FIG. 5, if the user puts bedding to be washed, in detail, a blanket or a cover, into the drum 12 and selects the bedding course button 101 disposed on the input unit 100 (200), operation information selected by the user is input to the controller 110 through the input unit 100.

Thus, the controller 110 detects the weight (load amount) of bedding put into the drum 12 so as to perform the bedding washing operation. Any one of a method of detecting the weight of bedding using a time at which a predetermined duty 90V is given to the motor 15 while the motor 15 is rotated at a weight detection rpm (about 70 to 150 rpm) and the motor 15 reaches the predetermined duty and a value of an angular velocity, a method of detecting the weight of bedding using a time at which the motor 15 reaches a predetermined speed (or a predetermined rpm) using instantaneous acceleration of the motor 15, and a method of detecting the weight of bedding using a second law of motion (torque=inertia×acceleration) after directly or indirectly measuring the amount of inertia of the drum 12 by giving a predetermined time torque to the motor 15, as disclosed in Japanese Patent Publication No. 2002-336593, Japanese Patent Publication No. 2004-267334, and Japanese Patent Publication No. 07-90077, may be used as a method of detecting the weight of bedding.

In addition, among well-known methods, the weight (load amount) of bedding may be detected using a load cell.

If the weight (load amount) of bedding is detected, the controller 110 sets a motor rpm and an operation rate (motor on-off time), a target washing water level and a target rinsing water level, and a washing time and a rinsing time according to the detected weight (load amount) of bedding.

The motor rpm and the operation rate (motor on-off time), the target washing water level and the target rinsing water level, and the washing time and the rinsing time that are set according to the weight (load amount) of bedding corresponds to a case that the user does not additionally input additional instructions regarding an operation of the washing machine 1. If the user additionally inputs additional instructions regarding the operation of the washing machine 1, the motor rpm and the operation rate (motor on-off time), the target washing water level and the target rinsing water level, and the washing time and the rinsing time that are set according to the weight (load amount) of bedding may be changed according to the user's instructions.

Subsequently, the controller 110 supplies water (washing water) set according to the weight (load amount) of bedding or the user's instructions. In this case, the controller 110 performs a bedding-dusting operation so as to remove foreign substances, such as dead mite bodies or dust on bedding, before supplying water (202).

The amount of bedding put into the drum 12 varies according to users. However, since bedding, such as a blanket or a cover, has a large volume and a large size, the internal space of the drum 12 is fully filled with only one bedding, and even though bedding has a small size, bedding with folded parts is put into the drum 12.

Thus, the controller 110 performs the bedding-dusting operation using high-temperature hot air and rotation of the drum 12 so as to remove foreign substances, such as dead mite bodies or dust adhered to bedding that is put into the drum 12 before the bedding washing operation is performed.

If the bedding-dusting operation starts, the drum 12 is rotated due to driving of the motor 15, bedding in the drum 12 is rotated, and air starts to flow in the washing machine 1 due to driving of the blower fan 66.

In this case, the heater 68 heats air that passes through the drying duct 64 so as to heat air that flows in the washing machine 1. Air (hot air) heated while passing through the drying duct 64 is introduced into the drum 12, and high-temperature hot air introduced into the drum 12 is in contact with bedding that is rotated while repeatedly lifting or falling in the drum 12 so that foreign substances, such as dead mite bodies or dust adhered to bedding that is not wet can be removed.

Performing an algorithm of the bedding-dusting operation will be described later in detail with reference to FIGS. 6 through 9.

In this way, if foreign substances, such as dead mite bodies or dust on bedding, are removed by performing the bedding-dusting operation, the controller 110 operates the water supply valves 32 so as to supply water (washing water) required for the bedding washing operation.

If the water supply valves 32 operate, the water supply valves 32 are open, and water (washing water) supplied via an external water supply pipe passes through the water supply pipes 31 and the detergent supply unit 20 and is supplied into the tub 11. In this case, detergent in the detergent supply unit 20 is dissolved by supplied water (washing water), passes through the connection pipe 35 together with the water (washing water) and is supplied into the tub 11 so that detergent water (water+detergent) is supplied to a lower part, in detail, a space between the tub 11 and the drum 12, of the tub 11 (204).

Thus, the controller 110 detects a level of water supplied to the tub 11 using the water level sensor 93, determines whether the detected water level is a set target washing water level (water level determined according to a set washing amount), and continuously performs a water supply operation until the level of water supplied to the tub 11 reaches the set target washing water level.

If the level of water supplied to the tub 11 through the water supply operation reaches the target washing water level, the controller 110 stops the water supply valves 32 so as to stop a washing water supply operation.

If a supply of washing water, in detail, detergent water, is completed up to the target washing water level, the controller 110 drives the motor 15 at a target rpm (about 45 to 70 rpm) and an operation rate (motor on-off time) that are set for the bedding washing operation, stirs the drum 12 right and left, and performs a washing operation using a flow and a water current of bedding that are generated due to right and left stirring of the drum 12 for a set washing time (206).

If washing is completed for the set washing time, the controller 110 stops the motor 15, drains detergent water (washing water+detergent) (208) and then performs intermediate dehydration (210).

Subsequently, the controller 110 operates the water supply valves 32 so as to supply water (rinsing water) required for bedding rinsing so as to perform a bedding rising operation.

If the water supply valves 32 operate, the water supply valves 32 are open, and water (rinsing water) passes through the water supply pipes 31 and is supplied into the tub 11 (212). In this case, the controller 110 controls a water supply operation with a stirring water supply of supplying rinsing water while stirring the drum 12 right and left so as to improve the performance of rinsing. Thus, due to intermediate dehydration after the washing operation is performed, bedding is detached from the drum 12 and is well mixed with water so that the effects of improving the performance of rinsing can be achieved.

Thus, the controller 110 detects a level of water supplied to the tub 11 using the water level sensor 93, determines whether the detected water level is a target rinsing water level (water level determined according to a set rinsing amount), and continuously performs the water supply operation until the level of water supplied to the tub 11 reaches the target rinsing water level.

If a supply of rinsing water is completed up to the target rinsing water level, the controller 110 drives the motor 15 at a target rpm (about 40 to 50 rpm) and an operation rate (motor on-off time) that are set for a bedding rinsing operation, stirs the drum 12 right and left, generates a water current that causes water (rinsing water) to contact laundry, thereby performing a rinsing operation (214).

If rinsing is completed for a set rinsing time, the controller 110 stops the motor 15 and drains water (rinsing water) (216). The rinsing operation is repeatedly performed for a predetermined number of times.

If the rinsing operation is performed for the predetermined number of times and last rinsing is completed, the controller 110 determines whether the last rinsing is completed (218), and if it is determined that the last rinsing is not completed, the controller 110 feeds back to Operation 210, performs intermediate dehydration and then performs subsequent operations.

As a result of determination in Operation 218, if the last rinsing is completed, the controller 110 performs a dehydration operation at a set final dehydration rpm (about 1000 rpm or less) (220).

If the dehydration operation is completed, the controller 110 performs a drying operation of drying bedding using high-temperature hot air (222).

If the drying operation starts, the drum 12 is rotated due to driving of the motor 15, bedding in the drum 12 is rotated, and air starts to flow in the washing machine 1 due to driving of the blower fan 66.

In this case, the heater 68 heats air that passes through the drying duct 64 so as to heat air that flows in the washing machine 1. Air (hot air) heated while passing through the drying duct 64 is introduced into the drum 12, and high-temperature hot air introduced into the drum 12 is in contact with bedding that is rotated while repeatedly lifting or falling in the drum 12 and dries bedding through a drying operation of evaporating moisture contained in wet bedding.

The bedding-dusting operation in accordance with an embodiment of the present disclosure is similar to the drying operation in that high-temperature hot air and rotation of the drum 12 are used in the bedding-dusting operation. However, the drying operation is an operation in which the motor 15 is driven at a predetermined rpm (about 45 rpm) and an operation rate (20 seconds on/2 seconds off) and the drum 12 is stirred and rotated at a predetermined speed so as to dry wet bedding. On the other hand, a driving profile in which the motor 15 is driven at various rpms (about 100 rpm, 60 rpm, and 40 rpm) and various operation rates (30 seconds on/2 seconds off, 30 seconds on/4 seconds off, 10 seconds on/20 seconds off) and the drum 12 is stirred and rotated at various speeds so as to remove foreign substances, such as dead mite bodies or dust adhered to bedding that is not wet, has been realized in the bedding-dusting operation.

Next, performing an algorithm of the bedding-dusting operation will be described with reference to FIGS. 6A through 6C.

Figure 6A:
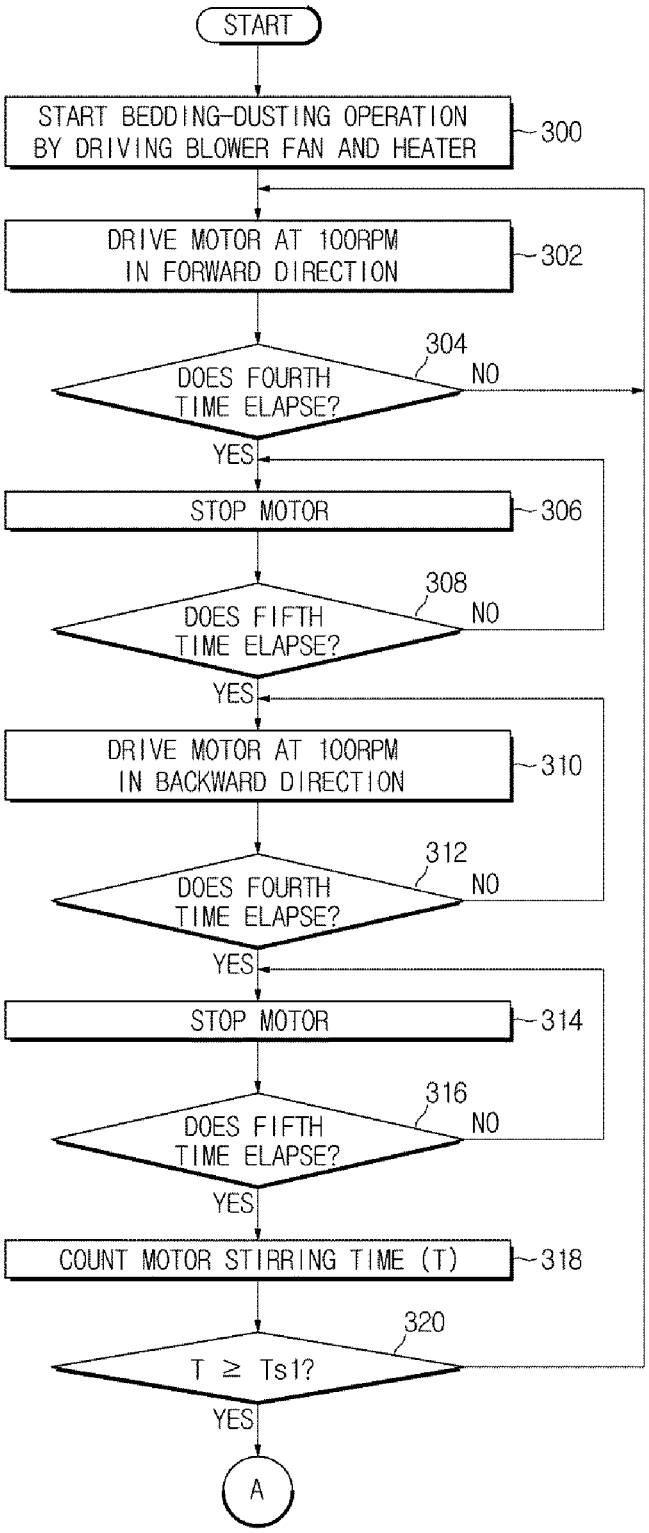
FIGS. 6A through 6C are operational flowcharts illustrating a bedding-dusting operation of the washing machine of FIG. 1.
Figure 6B:
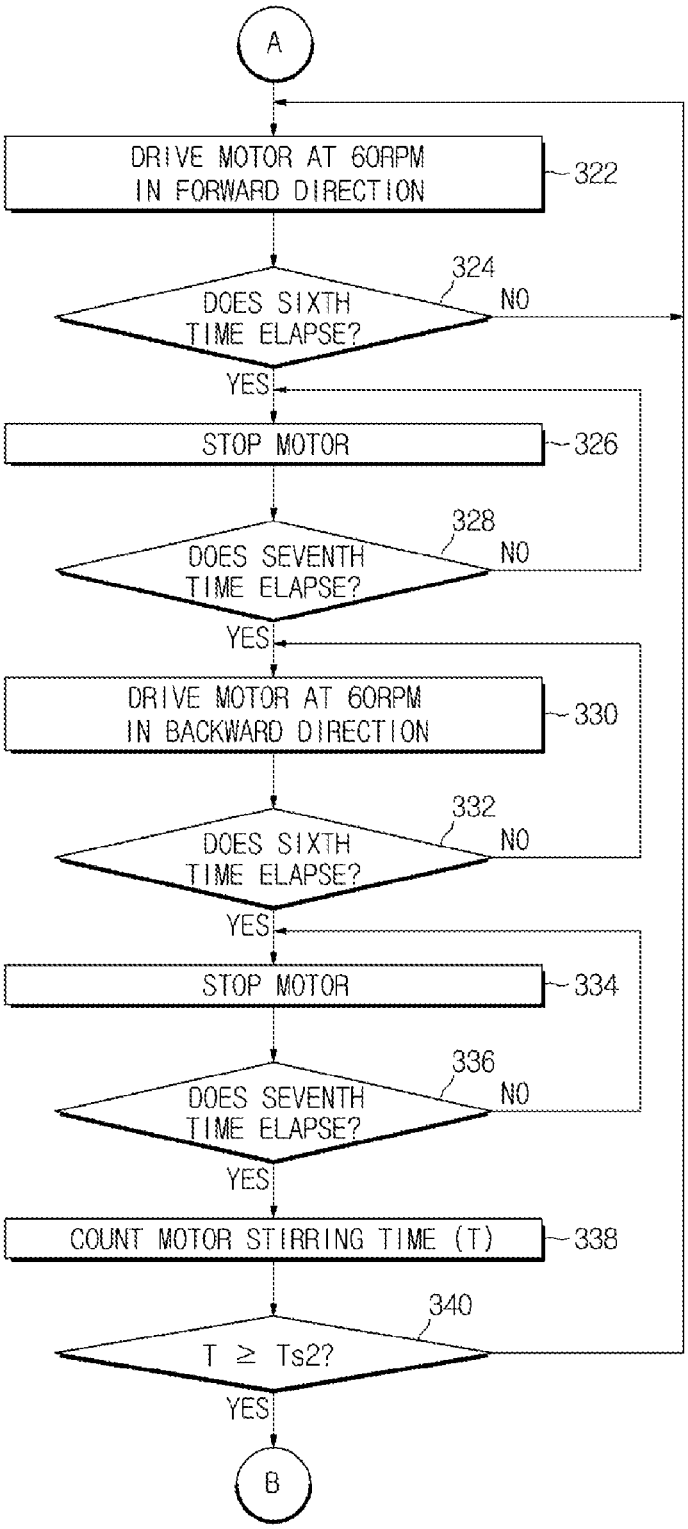
Figure 6C:
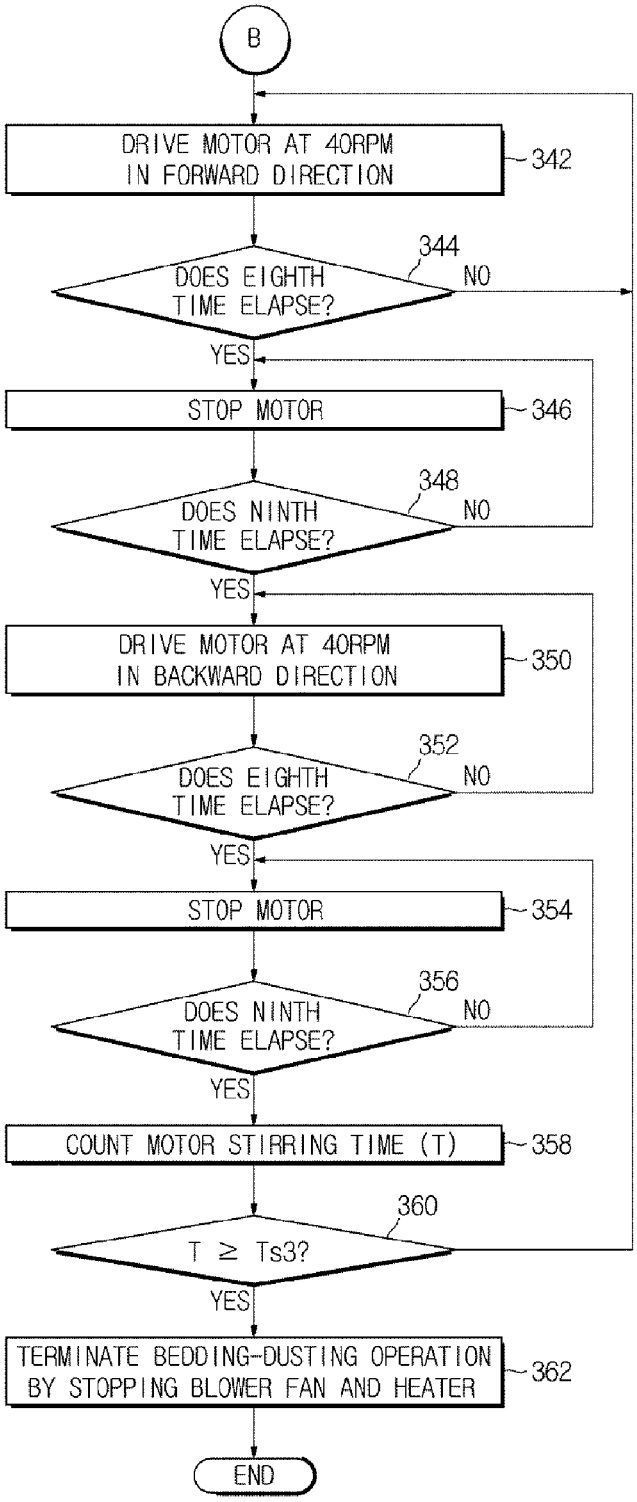

FIGS. 6A through 6C are operational flowcharts illustrating a bedding-dusting operation of the washing machine of FIG. 1.

Referring to FIGS. 6A through 6C, if the user puts bedding into the drum 12 and manipulates the bedding course button 101 of the input unit 100 so as to select the bedding washing course, the controller 110 drives the blower fan 66 and the heater 68 using the driving unit 130 and starts the bedding-dusting operation (300).

If the bedding-dusting operation starts, air starts to flow in the washing machine 1 due to driving of the blower fan 66, and the heater 68 heats air that passes through the drying duct 64 so as to heat air that flows in the washing machine 1. Air (hot air) heated while passing through the drying duct 64 is introduced into the drum 12.

When the blower fan 66 is driven, the controller 110 drives the motor 15 at a first rpm (about 100 rpm) in a forward direction using the driving unit 130 (302), counts a time at which the motor 15 is driven at the first rpm in the forward direction, and determines whether a predetermined fourth time (about 30 seconds) elapses (304).

As a result of determination in Operation 304, if the predetermined fourth time does not elapse, the controller 110 feeds back to Operation 302 and drives the motor 15 at the first rpm in the forward direction until the fourth time elapses.

In this way, if the motor 15 is driven at the first rpm in the forward direction for the fourth time (30 seconds), the drum 12 is strongly rotated in one direction. In this case, an air layer is formed in the center of bedding due to strong rotation of the drum 12 so that bedding is adhered to the drum 12.

As a result of determination in Operation 304, if the fourth time elapses, the controller 110 stops the motor 15 using the driving unit 130 (306), counts a time at which the motor 15 stops and determines whether a predetermined fifth time (about 2 seconds) elapses (308).

As a result of determination in Operation 308, if the fifth time does not elapse, the controller 110 feeds back to Operation 306 and stops the motor 15 until the fifth time elapses.

In this way, if the motor 15 is driven in the forward direction and then the motor 15 stops for the fifth time (2 seconds), bedding becomes untidy so that bedding may move in a predetermined shape, and thus bedding is detached from the drum 12.

As a result of determination in Operation 308, if the fifth time elapses, the controller 110 drives the motor 15 at the first rpm in a backward direction using the driving unit 130 (310), counts a time at which the motor 15 is driven at the first rpm in the backward direction, and determines whether the fourth time elapses (312).

As a result of determination in Operation 312, if the fourth time does not elapse, the controller 110 feeds back to Operation 310 and drives the motor 15 at the first rpm in the backward direction until the fourth time elapses.

In this way, if the motor 15 is driven at the first rpm in the backward direction for the fourth time (30 seconds), the drum 12 is strongly rotated in an opposite direction. In this way, the position of bedding is changed by a reaction of the drum 12 that is strongly rotated in the opposite direction, more air layers are formed in the center of bedding, and bedding is adhered to the drum 12.

As a result of determination in Operation 312, if the fourth time elapses, the controller 110 stops the motor 15 using the driving unit 130 (314), counts a time at which the motor 15 stops, and determines whether the fifth time elapses (316).

As a result of determination in Operation 316, if the fifth time does not elapse, the controller 110 feeds back to Operation 314 and stops the motor 15 until the fifth time elapses.

In this way, if the motor 15 is driven in the backward direction and then the motor 15 stops for the fifth time (2 seconds), the drum 12 stops and operates as well as the drum 12 is strongly rotated in the opposite direction, more air layers are introduced into bedding, bedding is widely spread, and a space is formed in the center of bedding so that bedding can be uniformly adhered to the drum 12.

As a result of determination in Operation 316, if the fifth time elapses, the controller 110 counts a performing time T of a first section of the bedding-dusting operation in which the motor 15 is driven at the first rpm in the forward or backward direction (318).

Subsequently, the controller 110 determines whether the counted motor stirring time T elapses a predetermined first time Ts1 (time at which a space is formed in the center of bedding and bedding is uniformly adhered to the drum 12, about 5 minutes) (320).

As a result of determination in Operation 320, if the first time Ts1 does not elapse, the controller 110 feeds back to Operation 302 and continuously performs the first section of the bedding-dusting operation until the first time Ts1 elapses.

As a result of determination in Operation 320, if the first time Ts1 elapses, the controller 110 determines that bedding is uniformly adhered to the drum 12 and terminates the first section of the bedding-dusting operation.

Subsequently, the controller 110 drives the motor 15 at a second rpm (about 60 rpm) in the forward direction using the driving unit 130 (322), counts a time at which the motor 15 is driven at the second rpm in the forward direction, and determines whether a predetermined sixth time (about 30 seconds) elapses (324).

As a result of determination in Operation 324, if the sixth time does not elapse, the controller 110 feeds back to Operation 322 and drives the motor 15 at the second rpm in the forward direction until the sixth time elapses.

In this way, if the motor 15 is driven at the second rpm in the forward direction for the sixth time (30 seconds), the drum 12 is strongly rotated in one direction. In this case, due to strong rotation of the drum 12, foreign substances, such as dead mite bodies or dust, start to be detached from bedding that is widely spread and is adhered to the drum 12.

As a result of determination in Operation 324, if the sixth time elapses, the controller 110 stops the motor 15 using the driving unit 130 (326), counts a time at which the motor 15 stops, and determines whether a predetermined seventh time (about 4 seconds) elapses (328).

As a result of determination in Operation 328, if the seventh time does not elapse, the controller 110 feeds back to Operation 326 and stops the motor 15 until the seventh time elapses.

In this way, if the motor 15 is driven in the forward direction and then the motor 15 stops for the seventh time (4 seconds), bedding is detached from the drum 12.

As a result of determination in Operation 328, if the seventh time elapses, the controller 110 drives the motor 15 at the second rpm in the backward direction using the driving unit 130 (330), counts a time at which the motor 15 is driven at the second rpm in the backward direction, and determines whether the sixth time elapses (332).

As a result of determination in Operation 332, if the sixth time does not elapse, the controller 110 feeds back to Operation 330 and drives the motor 15 at the second rpm in the backward direction until the sixth time elapses.

In this way, if the motor 15 is driven at the second rpm in the backward direction for the sixth time (30 seconds), the drum 12 is strongly rotated in the opposite direction. In this case, the position of bedding is changed by a reaction of the drum 12 that is strongly rotated in the opposite direction, and foreign substances, such as dead mite bodies or dust adhered to an opposite side of bedding, start to be detached therefrom.

As a result of determination in Operation 332, if the sixth time elapses, the controller 110 stops the motor 15 using the driving unit 130 (334), counts a time at which the motor 15 stops, and determines whether the seventh time elapses (336).

As a result of determination in Operation 336, if the seventh time does not elapse, the controller 110 feeds back to Operation 334 and stops the motor 15 until the seventh time elapses.

In this way, if the motor 15 is driven in the backward direction and then the motor 15 stops for the seventh time (4 seconds), the drum 12 stops and operates as well as the drum 12 is strongly rotated in the opposite direction, bedding is widely spread, and foreign substances, such as dead mite bodies or dust adhered to bedding, can be effectively removed.

As a result of determination in Operation 336, if the seventh time elapses, the controller 110 counts a performing time T of the second section of the bedding-dusting operation in which the motor 15 is driven at the second rpm in the forward or backward direction (338).

Subsequently, the controller 110 determines whether the counted motor stirring time T elapses a predetermined second time Ts2 (time at which foreign substances, such as dead mite bodies or dust, are intensely dusted from bedding, about 10 minutes) (340).

As a result of determination in Operation 340, if the second time Ts2 does not elapse, the controller 110 feeds back to Operation 322 and continuously performs the second section of the bedding-dusting operation until the second time Ts2 elapses.

As a result of determination in Operation 340, if the second time Ts2 elapses, the controller 110 determines that foreign substances, such as dead mite bodies or dust adhered to bedding, are removed and terminates the second section of the bedding-dusting operation.

Subsequently, the controller 110 drives the motor 15 at a third rpm (about 40 rpm) in the forward direction using the driving unit 130 (342), counts a time at which the motor 15 is driven at the third rpm in the forward direction, and determines whether a predetermined eighth time (about 10 seconds) elapses (344).

As a result of determination in Operation 344, if the eighth time does not elapse, the controller 110 feeds back to Operation 342 and drives the motor 15 at the third rpm in the forward direction until the eighth time elapses.

In this way, if the motor 15 is driven at the third rpm in the forward direction for the eighth time (10 seconds), the drum 12 is rotated at a relatively smaller rpm than the first rpm. In this case, due to rotation of the drum 12, bedding from which foreign substances, such as dead mite bodies or dust, are removed, is shaken and arranged.

As a result of determination in Operation 344, if the eighth time elapses, the controller 110 stops the motor 15 using the driving unit 130 (346), counts a time at which the motor 15 stops, and determines whether a predetermined ninth time (about 20 seconds) elapses (348).

As a result of determination in Operation 348, if the ninth time does not elapse, the controller 110 feeds back to Operation 346 and stops the motor 15 until the ninth time elapses.

In this way, if the motor 15 is driven in the forward direction and then the motor 15 stops for the ninth time (20 seconds), bedding is detached from the drum 12 and is uniformly distributed.

As a result of determination in Operation 348, if the ninth time elapses, the controller 110 drives the motor 15 at the third rpm in the backward direction using the driving unit 130 (350), counts a time at which the motor 15 is driven at the third rpm in the backward direction, and determines whether the eighth time elapses (352).

As a result of determination in Operation 352, if the eighth time does not elapse, the controller 110 feeds back to Operation 350 and drives the motor 15 at the third rpm in the backward direction until the eighth time elapses.

In this way, if the motor 15 is driven at the third rpm in the backward direction for the eighth time (10 seconds), the drum 12 is weakly rotated in the opposite direction. In this case, the position of bedding is changed by a reaction of the drum 12 that is weakly rotated in the opposite direction, and an opposite side of bedding is also arranged.

As a result of determination in Operation 352, if the eighth time elapses, the controller 110 stops the motor 15 using the driving unit 130 (354), counts a time at which the motor 15 stops, and determines whether the ninth time elapses (356).

As a result of determination in Operation 356, if the ninth time does not elapse, the controller 110 feeds back to Operation 354 and stops the motor 15 until the ninth time elapses.

In this way, if the motor 15 is driven in the backward direction and then the motor 15 stops for the ninth time (20 seconds), the drum 12 stops and operates as well as the drum 12 is weakly rotated in the opposite direction, bedding is widely spread, is shaken and arranged, and thus is uniformly distributed.

As a result of determination in Operation 356, if the ninth time elapses, the controller 110 counts a performing time T of the third section of the bedding-dusting operation in which the motor 15 is driven at the third rpm in the forward or backward direction (358).

Subsequently, the controller 110 determines whether the counted motor stirring time T elapses a predetermined third time Ts3 (a balance time at which bedding is shaken and arranged and is uniformly distributed, about 5 minutes) (360).

As a result of determination in Operation 360, if the third time Ts3 does not elapse, the controller 110 feeds back to Operation 342 and continuously performs the third section of the bedding-dusting operation until the third time Ts3 elapses.

As a result of determination in Operation 360, if the third time Ts3 elapses, the controller 110 determines that bedding is uniformly arranged and terminates the third section of the bedding-dusting operation (362).

Figure 7:
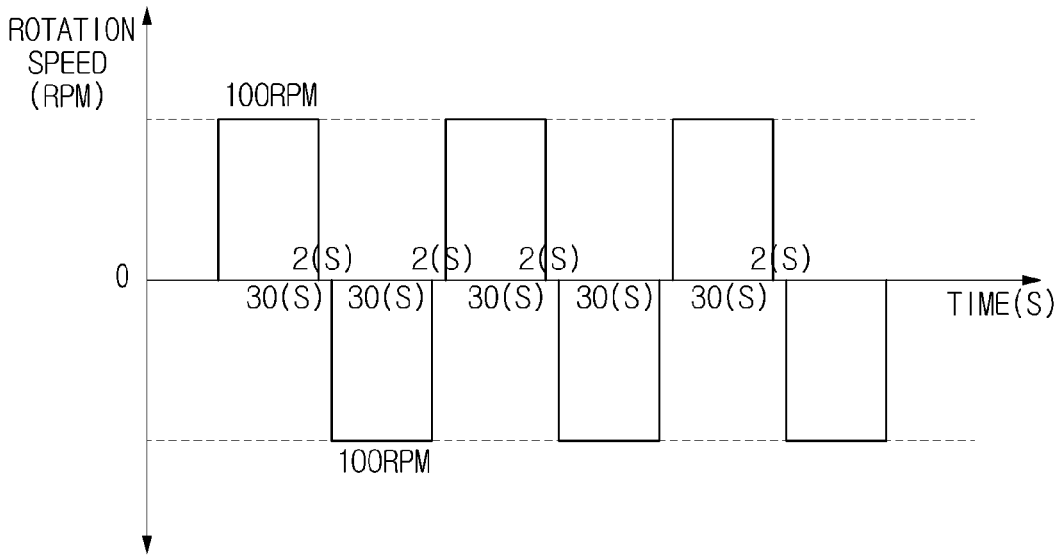
FIG. 7 is a graph showing a motor driving profile of a first section of the bedding-dusting operation of the washing machine of FIG. 1.
Figure 8:
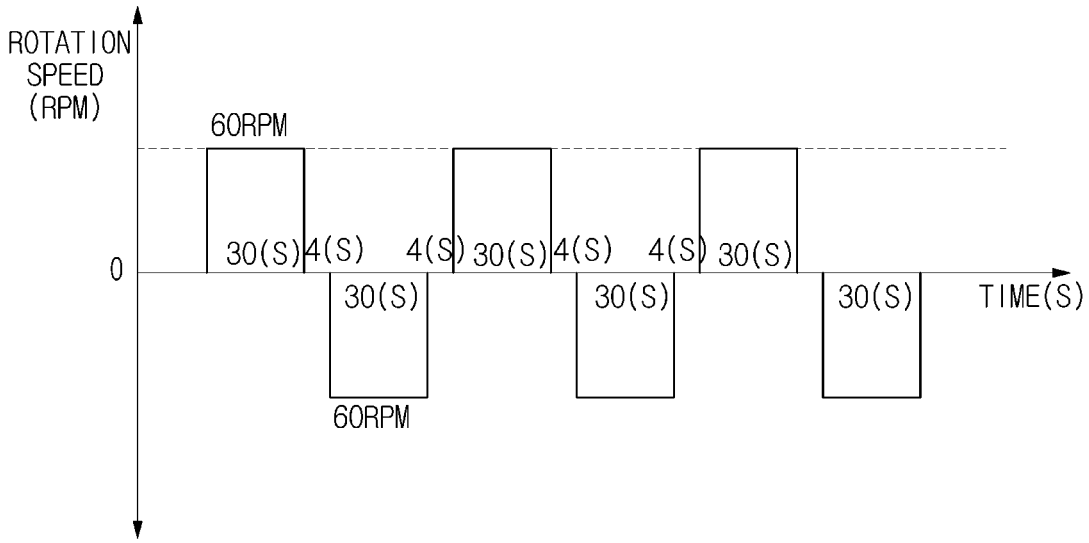
FIG. 8 is a graph showing a motor driving profile of a second section of the bedding-dusting operation of the washing machine of FIG. 1.
Figure 9:
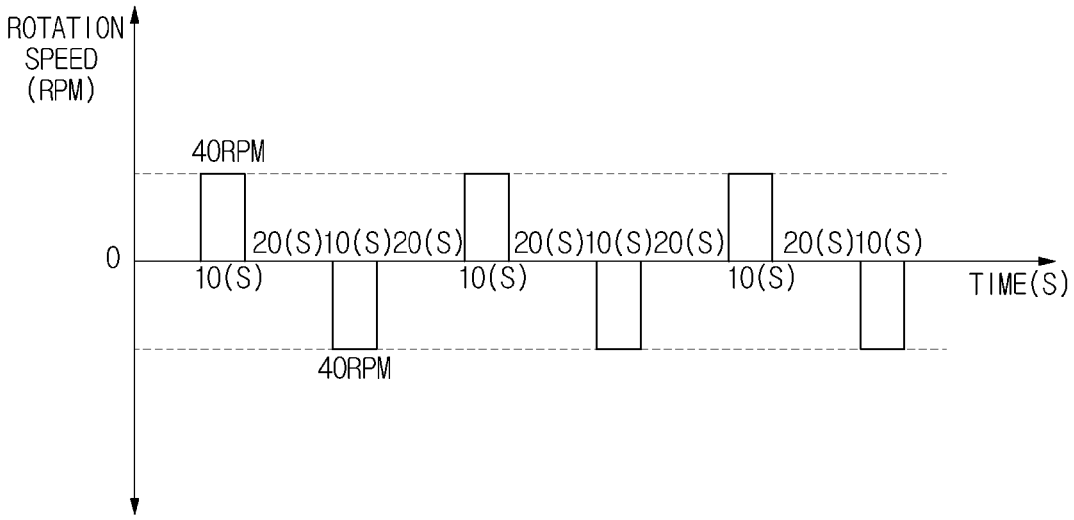
FIG. 9 is a graph showing a motor driving profile of a third section of the bedding-dusting operation of the washing machine of FIG. 1.

A driving profile of the motor 15 in which the drum 12 is stirred right and left in the first section, the second section, and the third section of the bedding-dusting operation, is as illustrated in FIGS. 7 through 9.

FIG. 7 is a graph showing a motor driving profile of a first section of the bedding-dusting operation of the washing machine of FIG. 1, FIG. 8 is a graph showing a motor driving profile of a second section of the bedding-dusting operation of the washing machine of FIG. 1, and FIG. 9 is a graph showing a motor driving profile of a third section of the bedding-dusting operation of the washing machine of FIG. 1.

In FIG. 7, in the first section of the bedding-dusting operation, the motor 15 is maintained at a first rpm (rpm at which all surfaces of bedding are uniformly adhered to the drum 12; about 100 rpm) and is driven at an operation rate of 30 seconds motor on/2 seconds motor off, the drum 12 is stirred right and left and is rotated, bedding is widely spread, and a space is formed in the center of bedding so that bedding can be uniformly adhered to the drum 12.

In an embodiment of the present disclosure, when the motor 15 is driven at an operation rate of 30 seconds motor on/2 seconds motor off while maintaining a motor rpm of the first section at 100 rpm and the drum 12 is stirred right and left for a first time (about 5 minutes), the motor rpm and the operation rate are maintained at the same level regardless of the number of times of right and left stirring. However, embodiments of the present disclosure are not limited thereto, and even when an on or off time of the motor operation rate is changed according to the number of times of right and left stirring, the same objectives and effects as those of the present disclosure can be achieved.

For example, when first right and left stirring is performed, the motor 15 may be driven at an operation rate of 30 seconds motor on/2 seconds motor off while maintaining the motor rpm at 100 rpm, and the drum 12 may be strongly stirred right and left, and when second right and left stirring is performed, the motor 15 may be driven at an operation rate of 28 seconds motor on/2 seconds motor off while maintaining the motor rpm at 100 rpm, and the drum 12 may be strongly stirred right and left, and when third right and left stirring is performed, the motor 15 may be driven at an operation rate of 26 seconds motor on/2 seconds motor off while maintaining the motor rpm at 100 rpm, and the drum 12 may be strongly stirred right and left. Accordingly, an on time of the motor operation rate is changed according to the number of times of performing right and left stirring of the drum 12 so that bedding can be uniformly adhered to the drum 12.

Also, when first right and left stirring is performed, the motor 15 may be driven at an operation rate of 30 seconds motor on/2 seconds motor off while maintaining the motor rpm at 100 rpm, and the drum 12 may be strongly stirred right and left, and when second right and left stirring is performed, the motor 15 may be driven at an operation rate of 30 seconds motor on/1 second motor off while maintaining the motor rpm at 100 rpm, and the drum 12 may be strongly stirred right and left. As right and left stirring of the drum 12 is performed, an off time of the motor operation rate is changed so that bedding can be uniformly adhered to the drum 12.

In addition, when first right and left stirring is performed, the motor 15 may be driven at an operation rate of 30 seconds motor on/2 seconds motor off while maintaining the motor rpm at 100 rpm, and the drum 12 may be strongly stirred right and left, and when second right and left stirring is performed, the motor 15 may be driven at an operation rate of 28 seconds motor on/1 second motor off while maintaining the motor rpm at 100 rpm, and the drum 12 may be strongly stirred right and left. As right and left stirring of the drum 12 is performed, both an on time and an off time of the motor operation rate are changed so that bedding can be uniformly adhered to the drum 12.

Also, in an embodiment of the present disclosure, the motor 15 may be driven at an operation rate of 30 seconds motor on/2 seconds motor off while maintaining the motor rpm of the first section at 100 rpm, and the drum 12 may be strongly stirred right and left. However, embodiments of the present disclosure are not limited thereto, and a motor rpm and an operation rate can be changed according to the weight of bedding.

For example, the motor rpm may be adjusted according to the weight of bedding, or a motor on time and a motor off time can be changed according to the weight of bedding. Thus, the motor rpm and the operation rate can be properly changed according to the weight of bedding so that bedding can be uniformly adhered to the drum 12.

In FIG. 8, in the second section of the bedding-dusting operation, the motor 15 is maintained at a second rpm (rpm at which foreign substances, such as dead mite bodies or dust, are dusted from bedding; about 60 rpm) and is driven at an operation rate of 30 seconds motor on/4 seconds motor off, the drum 12 is stirred right and left and is rotated so that foreign substances, such as dead mite bodies or dust adhered to bedding, can be intensely dusted.

In an embodiment of the present disclosure, when the motor 15 is driven at an operation rate of 30 seconds motor on/4 seconds motor off while maintaining a motor rpm of the second section at 60 rpm and the drum 12 is stirred right and left for a second time (about 10 minutes), the motor rpm and the operation rate are maintained at the same level regardless of the number of times of right and left stirring. However, embodiments of the present disclosure are not limited thereto, and even when an on or off time of the motor operation rate is changed according to the number of times of right and left stirring, the same objectives and effects as those of the present disclosure can be achieved.

For example, when first right and left stirring is performed, the motor 15 may be driven at an operation rate of 30 seconds motor on/4 seconds motor off while maintaining the motor rpm at 60 rpm, and the drum 12 may be strongly stirred right and left, and when second right and left stirring is performed, the motor 15 may be driven at an operation rate of 28 seconds motor on/4 seconds motor off while maintaining the motor rpm at 60 rpm, and the drum 12 may be strongly stirred right and left, and when third right and left stirring is performed, the motor 15 may be driven at an operation rate of 26 seconds motor on/4 seconds motor off while maintaining the motor rpm at 60 rpm, and the drum 12 may be strongly stirred right and left. Thus, an on time of the motor operation rate is changed according to the number of times of performing right and left stirring of the drum 12 so that foreign substances, such as dead mite bodies or dust adhered to bedding, can be intensely dusted.

Also, when first right and left stirring is performed, the motor 15 may be driven at an operation rate of 30 seconds motor on/4 seconds motor off while maintaining the motor rpm at 60 rpm, and the drum 12 may be strongly stirred right and left, and when second right and left stirring is performed, the motor 15 may be driven at an operation rate of 30 seconds motor on/2 seconds motor off while maintaining the motor rpm at 60 rpm, and the drum 12 may be strongly stirred right and left. As right and left stirring of the drum 12 is performed, an off time of the motor operation rate is changed so that foreign substances, such as dead mite bodies or dust adhered to bedding, can be intensely dusted.

In addition, when first right and left stirring is performed, the motor 15 may be driven at an operation rate of 30 seconds motor on/4 seconds motor off while maintaining the motor rpm at 60 rpm, and the drum 12 may be strongly stirred right and left, and when second right and left stirring is performed, the motor 15 may be driven at an operation rate of 28 seconds motor on/2 seconds motor off while maintaining the motor rpm at 60 rpm, and the drum 12 may be strongly stirred right and left. As right and left stirring of the drum 12 is performed, both an on time and an off time of the motor operation rate are changed so that foreign substances, such as dead mite bodies or dust, can be intensely dusted.

In FIG. 9, in the third section of the bedding-dusting operation, the motor 15 is maintained at a third rpm (rpm at which bedding can be uniformly distributed; about 40 rpm) and is driven at an operation rate of 10 seconds motor on/20 seconds motor off, and the drum 12 is stirred right and left and is rotated so that bedding can be shaken and arranged and can be uniformly distributed in the internal space of the drum 12.

In an embodiment of the present disclosure, when the motor 15 is driven at an operation rate of 10 seconds motor on/20 seconds motor off while maintaining a motor rpm of the third section at 40 rpm and the drum 12 is stirred right and left for a third time (about 5 minutes), the motor rpm and the operation rate are maintained at the same level regardless of the number of times of right and left stirring. However, embodiments of the present disclosure are not limited thereto, and even when an on or off time of the motor operation rate is changed according to the number of times of right and left stirring, the same objectives and effects as those of the present disclosure can be achieved.

For example, when first right and left stirring is performed, the motor 15 may be driven at an operation rate of 10 seconds motor on/20 seconds motor off while maintaining the motor rpm at 40 rpm, and the drum 12 may be weakly stirred right and left, and when second right and left stirring is performed, the motor 15 may be driven at an operation rate of 8 seconds motor on/20 seconds motor off while maintaining the motor rpm at 40 rpm, and the drum 12 may be weakly stirred right and left, and when third right and left stirring is performed, the motor 15 may be driven at an operation rate of 6 seconds motor on/20 seconds motor off while maintaining the motor rpm at 40 rpm, and the drum 12 may be weakly stirred right and left. Thus, an on time of the motor operation rate is changed according to the number of times of performing right and left stirring of the drum 12 so that bedding can be uniformly distributed into the drum 12.

Also, when first right and left stirring is performed, the motor 15 may be driven at an operation rate of 10 seconds motor on/20 seconds motor off while maintaining the motor rpm at 40 rpm, and the drum 12 may be weakly stirred right and left, and when second right and left stirring is performed, the motor 15 may be driven at an operation rate of 10 seconds motor on/15 seconds motor off while maintaining the motor rpm at 40 rpm, and the drum 12 may be weakly stirred right and left. As right and left stirring of the drum 12 is performed, an off time of the motor operation rate is changed so that bedding can be uniformly distributed into the drum 12.

In addition, when first right and left stirring is performed, the motor 15 may be driven at an operation rate of 10 seconds motor on/20 seconds motor off while maintaining the motor rpm at 40 rpm, and the drum 12 may be weakly stirred right and left, and when second right and left stirring is performed, the motor 15 may be driven at an operation rate of 8 seconds motor on/15 seconds motor off while maintaining the motor rpm at 40 rpm, and the drum 12 may be weakly stirred right and left. As right and left stirring of the drum 12 is performed, both an on time and an off time of the motor operation rate are changed so that bedding can be uniformly distributed into the drum 12.

In FIG. 5, a case that the bedding-dusting operation is performed before the bedding washing operation is performed, has been described.

Hereinafter, a case that the bedding-dusting operation is performed both before and after the bedding washing operation is performed, will be described with reference to FIG. 10.

Figure 10:
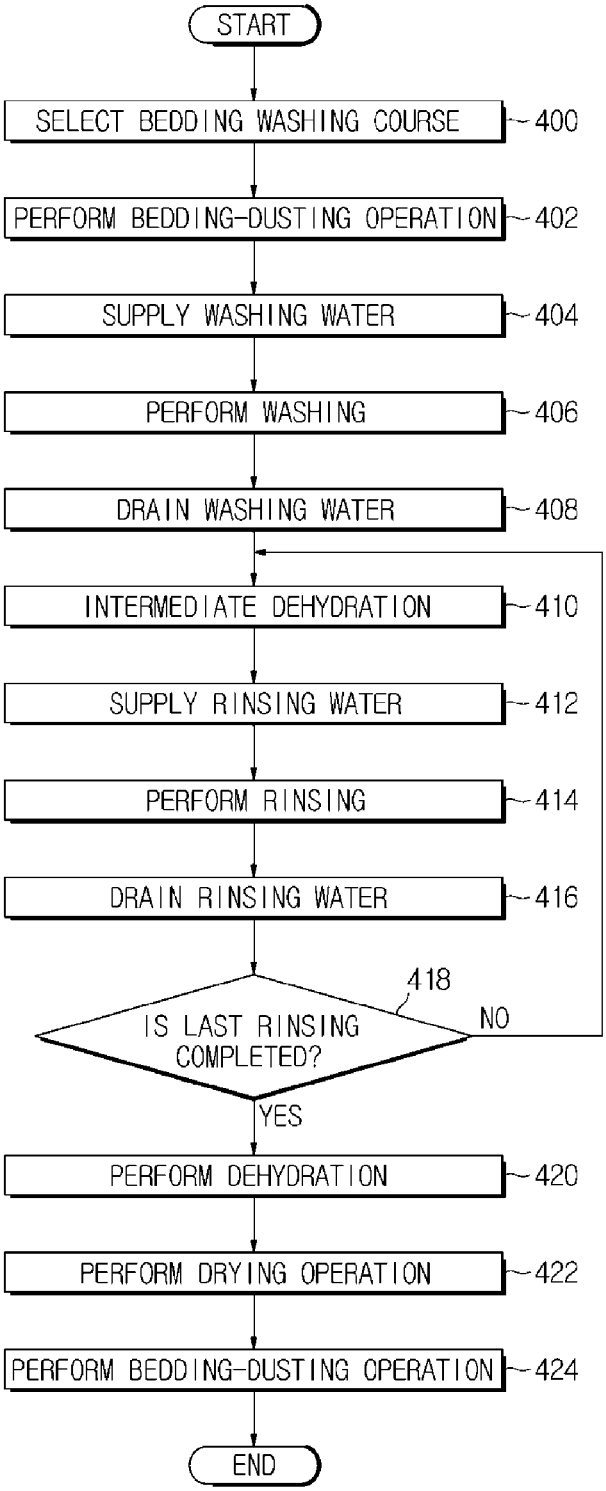
FIG. 10 is an operational flowchart illustrating a second control algorithm for washing bedding using the washing machine having a drying apparatus of FIG. 1.

FIG. 10 is an operational flowchart illustrating a second control algorithm for washing bedding using the washing machine having a drying apparatus of FIG. 1. Detailed descriptions of the same portions as those of FIG. 5 will be omitted.

In FIG. 10, the user puts bedding (in detail, a blanket or cover) to be washed into the drum 12 and manipulates the bedding course button 101 disposed on the input unit 100 to select the bedding washing course (400).

Thus, if the bedding washing course is selected and operation instructions are input, the controller 110 performs a bedding-dusting operation so as to remove foreign substances, such as dead mite bodies or dust adhered to bedding, before a bedding washing operation is performed (402).

The amount of bedding put into the drum 12 varies according to users. Since bedding, such as a blanket or cover, has a large volume and a large size, the internal space of the drum 12 is fully filled with only one bedding, and even though bedding has a small size, bedding with folded parts is put into the drum 12.

Thus, the controller 110 performs the bedding-dusting operation using high-temperature hot air and rotation of the drum 12 so as to remove foreign substances, such as dead mite bodies or dust adhered to bedding put into the drum 12, before the bedding washing operation is performed.

If the bedding-dusting operation starts, the drum 12 is rotated due to driving of the motor 15, bedding in the drum 12 is rotated, and air in the washing machine 1 starts to flow due to driving of the blower fan 66.

In this case, the heater 68 heats air that passes through the drying duct 64 so as to heat air that flows in the washing machine 1. Air (hot air) heated while passing through the drying duct 64 is introduced into the drum 12, and high-temperature hot air introduced into the drum 12 contacts bedding that is rotated while repeatedly lifting and falling in the drum 12 so that foreign substances, such as dead mite bodies or dust adhered to bedding before being washed, can be removed.

Performing an algorithm of the bedding-dusting operation has been already described with reference to FIGS. 6 through 9.

In this way, if foreign substances, such as dead mite bodies or dust adhered to bedding, are removed through the bedding-dusting operation, the controller 110 operates the water supply valves 32 so as to supply water (washing water) required for the bedding washing operation.

If the water supply valves 32 operate, the water supply valves 32 are open, water (washing water) supplied through an external water supply pipe passes through the water supply pipes 31 and the detergent supply unit 20 and is supplied into the tub 11 (404).

Thus, the controller 110 detects a level of water supplied into the tub 11 using the water level sensor 93, determines whether the detected water level is a set target washing water level (water level determined according to a set washing amount), and continuously performs a water supply operation until the level of water supplied into the tub 11 reaches the set target washing water level.

If a supply of washing water, in detail, detergent water, is completed up to the target washing water level, the controller 110 drives the motor 15 at a target rpm (about 45 to 70 rpm) and an operation rate (motor on-off time) that are set for the bedding washing operation so as to stir the drum 12 right and left, and performs a washing operation for a set washing time using a flow and a water current of bedding that are generated due to right and left stirring of the drum 12 (406).

If washing is completed for the set washing time, the controller 110 stops the motor 15, drains detergent water (washing water+detergent) (408), and then performs intermediate dehydration (410).

Subsequently, the controller 110 operates the water supply valves 32 so as to supply water (rinsing water) required for bedding rinsing so as to perform a bedding rising operation.

If the water supply valves 32 operate, the water supply valves 32 are open, and water (rinsing water) passes through the water supply pipes 31 and is supplied into the tub 11 (412).

Thus, the controller 110 detects a level of water supplied into the tub 11 using the water level sensor 93, determines whether the detected water level is a set target rinsing water level (water level determined according to a set rinsing amount), and continuously performs a water supply operation until the level of water supplied into the tub 11 reaches the set target rinsing water level.

If a supply of rinsing water is completed up to the target rinsing water level, the controller 110 drives the motor 15 at a target rpm (about 40 to 50 rpm) and an operation rate (motor on-off time) that are set for the bedding rinsing operation so as to stir the drum 12 right and left, generates a water current in which water (rinsing water) is in contact with laundry, thereby performing a rinsing operation (414).

If rinsing is completed for the set rinsing time, the controller 110 stops the motor 15 and drains water (rinsing water) (416). The rinsing operation is repeatedly performed for a predetermined number of times.

If the rinsing operation is performed for the predetermined number of times and last rinsing is completed, the controller 110 determines whether last rinsing is completed (418). If last rinsing is not completed, the controller 110 feeds back to Operation 410, performs intermediate dehydration, and then performs subsequent operations.

As a result of determination in Operation 418, if last rinsing is completed, the controller 110 performs a dehydration operation at a set final dehydration rpm (about 1000 rpm or less) (420).

If the dehydration operation is completed, the controller 110 performs a drying operation of drying bedding using high-temperature hot air (422).

If the drying operation starts, the drum 12 is rotated due to driving of the motor 15, bedding in the drum 12 is rotated, and air starts to flow in the washing machine 1 due to driving of the blower fan 66.

In this case, the heater 68 heats air that passes through the drying duct 64 so as to heat air that flows in the washing machine 1. Air (hot air) heated while passing through the drying duct 64 is introduced into the drum 12, and high-temperature hot air introduced into the drum 12 contacts bedding that is rotated while repeatedly lifting and falling in the drum 12, and bedding is dried through a drying operation of evaporating moisture contained in wet bedding.

Subsequently, if the drying operation is completed, the controller 110 performs the bedding-dusting operation so as to remove foreign substances, such as dead mite bodies or dust adhered to dried bedding (424).

If the bedding-dusting operation starts, the drum 12 is rotated due to driving of the motor 15, bedding in the drum 12 is rotated, and air starts to flow in the washing machine 1 due to driving of the blower fan 66.

In this case, the heater 68 heats air that passes through the drying duct 64 so as to heat air that flows in the washing machine 1. Air (hot air) heated while passing through the drying duct 64 is introduced into the drum 12, and high-temperature hot air introduced into the drum 12 contacts bedding that is rotated while repeatedly lifting and falling in the drum 12 so that foreign substances, such as dead mite bodies or dust adhered to dried bedding, can be removed.

Figure 11:
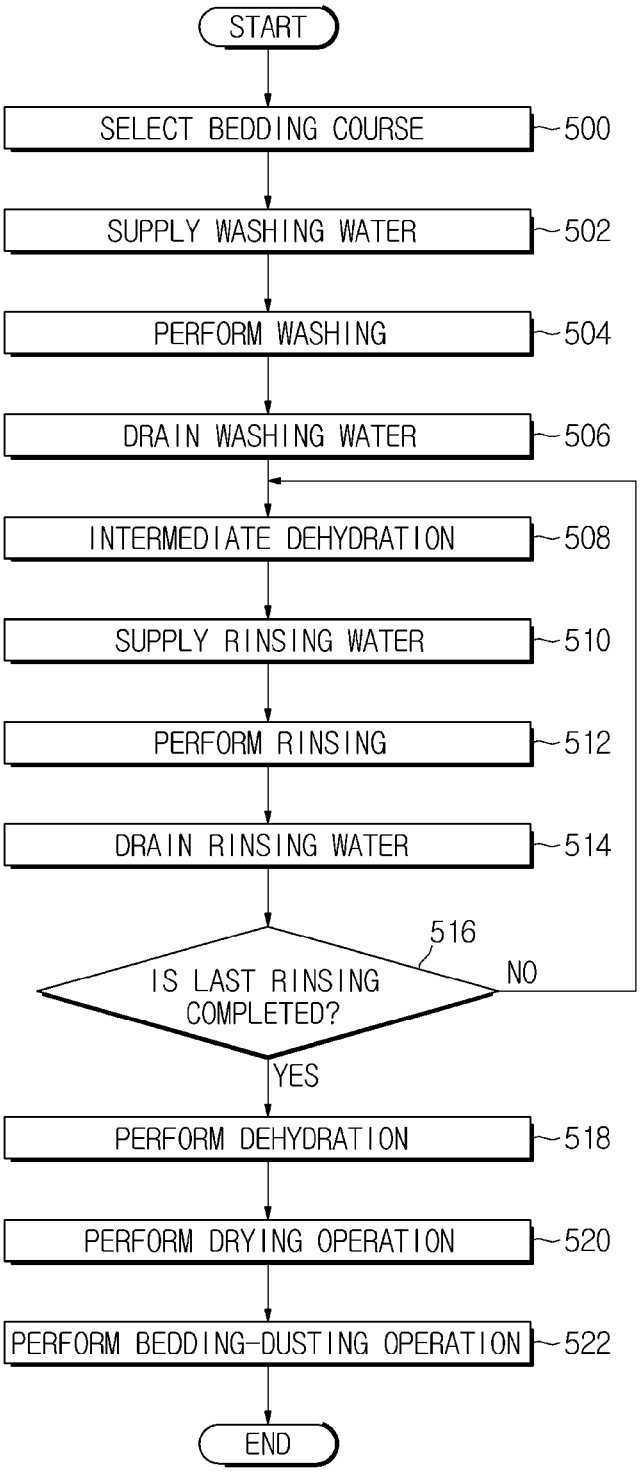
FIG. 11 is an operational flowchart illustrating a third control algorithm for washing bedding using the washing machine having a drying apparatus of FIG. 1.

Next, a case that the bedding-dusting operation is performed after the bedding washing operation is performed, will be described with reference to FIG. 11. FIG. 11 is an operational flowchart illustrating a third control algorithm for washing bedding using the washing machine having a drying apparatus of FIG. 1. Detailed descriptions of the same portions as those of FIG. 5 will be omitted.

In FIG. 11, the user puts bedding (in detail, a blanket or cover) to be washed into the drum 12 and manipulates the bedding course button 101 disposed on the input unit 100 to select the bedding washing course (500).

Thus, the controller 110 operates the water supply valves 32 so as to supply water (washing water) required for the bedding washing operation.

If the water supply valves 32 operate, the water supply valves 32 are open, water (washing water) supplied through an external water supply pipe passes through the water supply pipes 31 and the detergent supply unit 20 and is supplied into the tub 11 (502).

Thus, the controller 110 detects a level of water supplied into the tub 11 using the water level sensor 93, determines whether the detected water level is a set target washing water level (water level determined according to a set washing amount), and continuously performs a water supply operation until the level of water supplied into the tub 11 reaches the set target washing water level.

If a supply of washing water, in detail, detergent water, is completed up to the target washing water level, the controller 110 drives the motor 15 at a target rpm (about 45 to 70 rpm) and an operation rate (motor on-off time) that are set for the bedding washing operation so as to stir the drum 12 right and left, and performs a washing operation for a set washing time using a flow and a water current of bedding that are generated due to right and left stirring of the drum 12 (504).

If washing is completed for the set washing time, the controller 110 stops the motor 15, drains detergent water (washing water+detergent) (506), and then performs intermediate dehydration (508).

Subsequently, the controller 110 operates the water supply valves 32 so as to supply water (rinsing water) required for bedding rinsing so as to perform a bedding rising operation.

If the water supply valves 32 operate, the water supply valves 32 are open, and water (rinsing water) passes through the water supply pipes 31 and is supplied into the tub 11 (510).

Thus, the controller 110 detects a level of water supplied into the tub 11 using the water level sensor 93, determines whether the detected water level is a set target rinsing water level (water level determined according to a set rinsing amount), and continuously performs a water supply operation until the level of water supplied into the tub 11 reaches the set target rinsing water level.

If a supply of rinsing water is completed up to the target rinsing water level, the controller 110 drives the motor 15 at a target rpm (about 40 to 50 rpm) and an operation rate (motor on-off time) that are set for the bedding rinsing operation so as to stir the drum 12 right and left, generates a water current in which water (rinsing water) is in contact with laundry, thereby performing a rinsing operation (512).

If rinsing is completed for the set rinsing time, the controller 110 stops the motor 15 and drains water (rinsing water) (514). The rinsing operation is repeatedly performed for a predetermined number of times.

If the rinsing operation is performed for the predetermined number of times and last rinsing is completed, the controller 110 determines whether last rinsing is completed (516). If last rinsing is not completed, the controller 110 feeds back to Operation 508, performs intermediate dehydration, and then performs subsequent operations.

As a result of determination in Operation 516, if last rinsing is completed, the controller 110 performs a dehydration operation at a set final dehydration rpm (about 1000 rpm or less) (518).

If the dehydration operation is completed, the controller 110 performs a drying operation of drying bedding using high-temperature hot air (520).

If the drying operation starts, the drum 12 is rotated due to driving of the motor 15, bedding in the drum 12 is rotated, and air starts to flow in the washing machine 1 due to driving of the blower fan 66.

In this case, the heater 68 heats air that passes through the drying duct 64 so as to heat air that flows in the washing machine 1. Air (hot air) heated while passing through the drying duct 64 is introduced into the drum 12, and high-temperature hot air introduced into the drum 12 contacts bedding that is rotated while repeatedly lifting and falling in the drum 12, and bedding is dried through a drying operation of evaporating moisture contained in wet bedding.

Subsequently, if the drying operation is completed, the controller 110 performs the bedding-dusting operation so as to remove foreign substances, such as dead mite bodies or dust adhered to dried bedding (522).

If the bedding-dusting operation starts, the drum 12 is rotated due to driving of the motor 15, bedding in the drum 12 is rotated, and air starts to flow in the washing machine 1 due to driving of the blower fan 66.

In this case, the heater 68 heats air that passes through the drying duct 64 so as to heat air that flows in the washing machine 1. Air (hot air) heated while passing through the drying duct 64 is introduced into the drum 12, and high-temperature hot air introduced into the drum 12 contacts bedding that is rotated while repeatedly lifting and falling in the drum 12 so that foreign substances, such as dead mite bodies or dust adhered to dried bedding, can be removed.

In an embodiment of the present disclosure, the washing performance of bedding is improved using the washing machine 1 having the drying apparatus. However, embodiments of the present disclosure are not limited thereto, and the same objectives and effects as those of the present disclosure can be achieved in any type of home appliance having a drying apparatus, for example, a drying machine.

Figure 12:
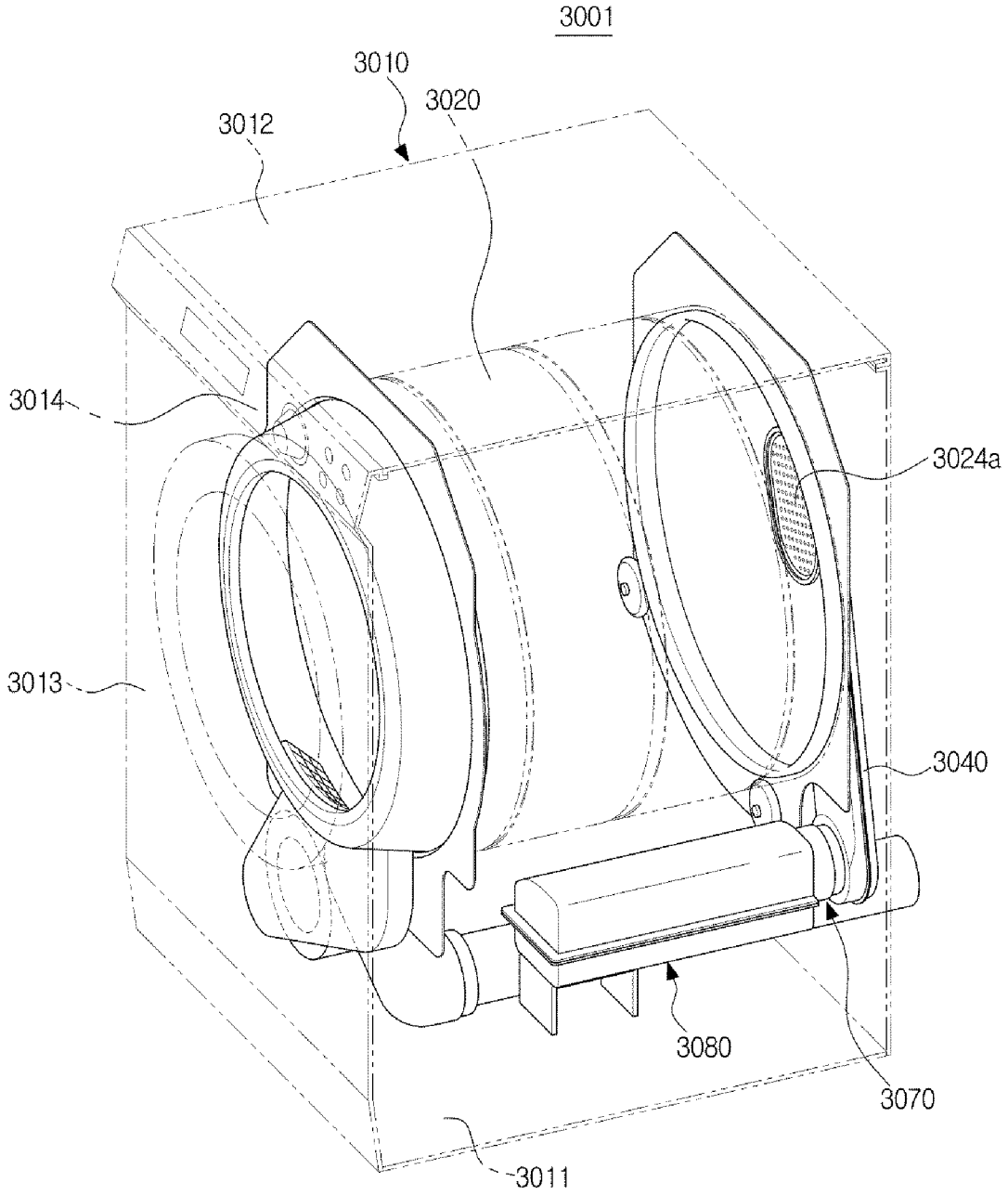
FIG. 12 is a perspective view of a drying machine in accordance with another embodiment of the present disclosure.
Figure 13:
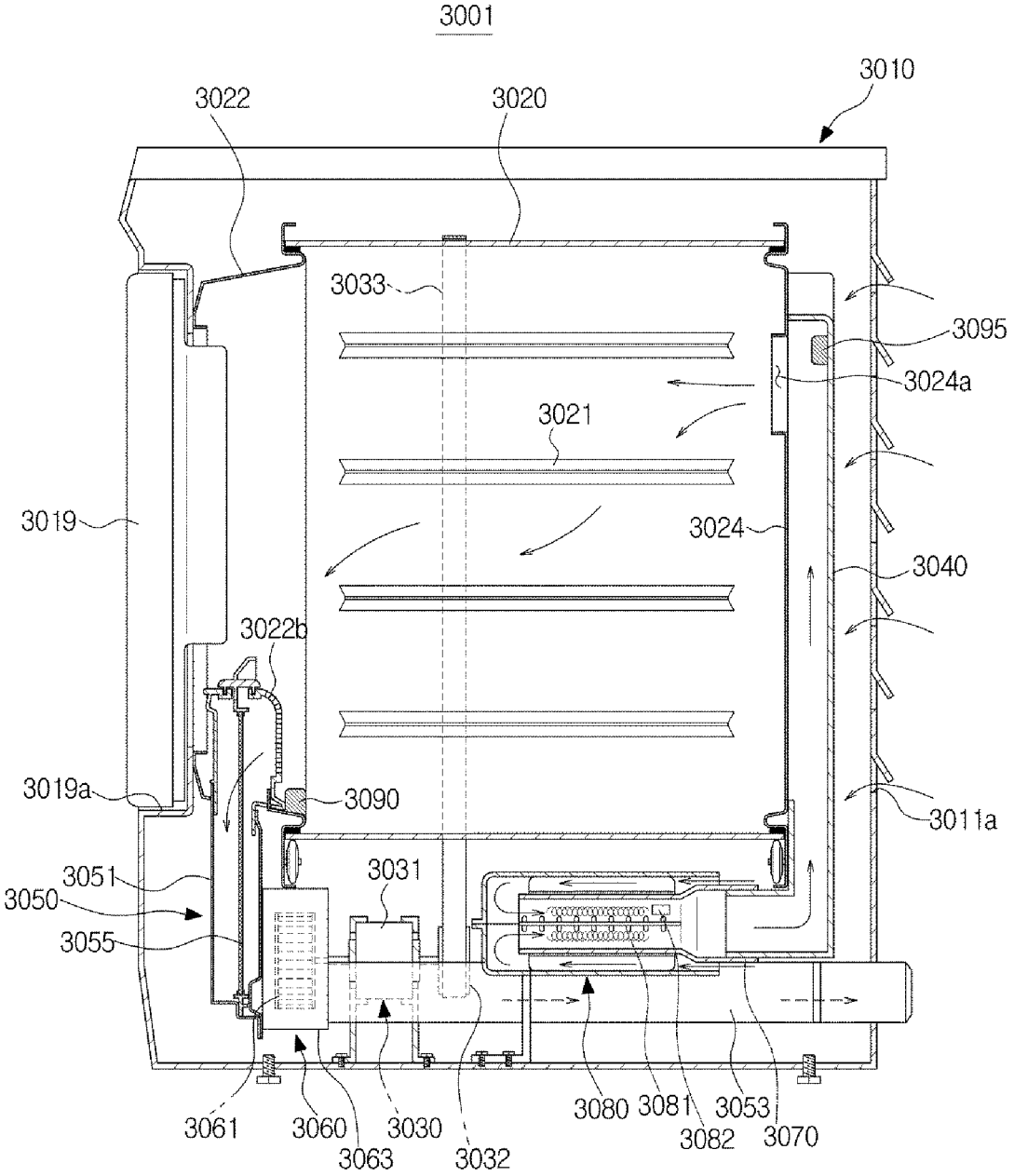
FIG. 13 is a side cross-sectional view of the drying machine illustrated in FIG. 12.

FIG. 12 is a perspective view of a drying machine in accordance with another embodiment of the present disclosure, and FIG. 13 is a side cross-sectional view of the drying machine illustrated in FIG. 12.

In FIGS. 12 and 13, a drying machine 3001 in accordance with another embodiment of the present disclosure includes a body 3010 having an approximately hexahedral shape, a drum 3020 that is rotatably installed in the body 3010 and has a space in which laundry, such as bedding, is dried, a driving unit 3030 that rotates the drum 3020, and a hot air duct 3070 that supplies hot air to the drum 3020.

The body 3010 may include a cabinet 3011, a top cover 3012 that covers an upper part of the cabinet 3011, a front panel 3013 disposed at a front side of the cabinet 3011, and a control panel 3014 on which various buttons for controlling the drying machine 3001 and displays are disposed.

The drum 3020 has a cylindrical shape in which front and rear sides of the drum 3020 are open. The drum 3020 includes a plurality of lifters 3021 that protrude in a mountain shape from an inner side of the drum 3020 so as to lift and fall laundry. Also, a front support plate 3022 and a rear support plate 3024 are installed at an inner side of the body 3010 and are fixed to an inner side of the front side and an inner side of the rear side of the body 3010, respectively, so as to rotatably support the front and rear open parts of the drum 3020 and simultaneously, to cover the front and rear open parts of the drum 3020.

A laundry port 3019*a* through which laundry may be put into the drum 3020, is disposed at a front side of the body 3010 and the front support plate 3022, and a door 3019 that opens/closes the laundry port 3019*a*, is installed at a front side of the body 3010.

The driving unit 3030 includes a driving motor 3031 installed at an inner lower part of the cabinet 3011, and a pulley 3032 and a rotation belt 3033 that transfer power of the driving motor 3031 to the drum 3020. The rotation belt 3033 is installed to be wound around the pulley 3032 coupled to an outer side of the drum 3020 and a shaft of the driving motor 3031.

The hot air duct 3070 includes a heating portion 3080 that heats introduced air and a hot air supply portion 3040 that connects the heating portion 3080 and the drum 3020.

The hot air supply portion 3040 connects a drum inhalation hole 3024*a* formed at an upper part of the rear support plate 3024 and the heating portion 3080 so as to constitute an air flow path. The hot air supply portion 3040 guides inhaled and heated air to the drum 3020.

The heating portion 3080 is installed at a lower part of the drum 3020, guides introduction of external air and heats introduced air. The heating portion 3080 includes a heater 3081 that dissipates heat in the heating portion 3080 and a thermostat 3082 that is installed for safety of the heater 3081.

A coil heater is mainly used as the heater 3081, and the heater 3081 may include one or more heaters. In this case, one or more heaters may have different power capacities or the same power capacity. For example, when the entire power capacity (100%) is 5.3 kW, one heater may use a large power capacity of about 3.7 kW (70%) of power capacity, and the other heater may use a small power capacity of about 1.6 kW (30%). In this case, a capacity of one or more heaters is not necessarily divided at a ratio of 70%:30% and may be divided at various ratios by searching for an optimum division condition.

The thermostat 3082 is a safety device that is installed on the side of or in the vicinity of the heater 3081, operates mechanically with respect to the temperature of the heater 3081, and is turned on/off. The thermostat 3082 is maintained in an on state before the temperature of the heater 3081 reaches a predetermined overheating temperature, and is changed into an off state if the temperature of the heater 3081 reaches the predetermined overheating temperature so that a common power cannot be applied to the heater 3081.

Also, an exhaust duct 3050 is connected to a front lower part of the drum 3020. The exhaust duct 3050 guides discharge of air introduced into the drum 3020. The exhaust duct 3050 includes a front exhaust duct 3051 that connects an exhaust pipe 3022*b* disposed below the front support plate 3022 and an inlet of a blower unit 3060 installed at a lower part of the drum 3020, and a rear exhaust duct 3053 that is installed at a lower side of the cabinet 3011 so that an outlet of the blower unit 3060 and a rear outer side of the cabinet 3011 communicate with each other.

A filter member 3055 is installed at the front exhaust duct 3051 so as to filter foreign substances, such as dust or lint contained in hot air discharged from the drum 3020.

The blower unit 3060 of which inlet is connected to the front exhaust duct 3051, includes a blower fan 3061 that is installed at a lower front of the drum 3020 and a blower case 3063 that surrounds a periphery of the blower fan 3061 and is connected to each of the front exhaust duct 3051 and the rear exhaust duct 3053.

Also, a drying degree sensor 3090 is installed at a front bottom end of the drum 3020 in which the exhaust pipe 3022*b* is formed. The drying degree sensor 3090 contacts laundry rotated due to rotation of the drum 3020, measures sensing values of electrical signals that vary according to the amount of moisture contained in laundry, and determines a drying degree of laundry. A plate bar-shaped touch sensor is used as the drying degree sensor 3090.

Also, a temperature sensor 3095 is installed at a rear top end of the drum 3020 in which the inhalation hole 3024*a* is formed, i.e., at an upper part of the hot air supply portion 3040. The temperature sensor 3095 detects the temperature of air introduced into the drum 3020, i.e., the temperature of an inlet of the drum 3020.

The drying machine 3001 in accordance with another embodiment of the present disclosure further includes an external exhaust duct that guides air to the outdoor so as to discharge air passing through the drum 3020 to an outer side of the drying machine 3001.

Also, the drying machine 3001 in accordance with another embodiment of the present disclosure has been described as an exhaust type drying machine that discharges high-temperature humid air that passes through the drum 3020 to an outer side of the drying machine 3001. However, embodiments of the present disclosure are not limited thereto, and a condensation type drying machine that removes moisture from high-temperature humid air passing through the drum 3020 and then circulates air into the drum 3020 may be used as the drying machine 3001.

As described above, in a drying apparatus, a washing machine having the drying apparatus, and a method of controlling the drying apparatus according to the embodiments of the present disclosure, when bedding having a large volume, such as a blanket or a cover, is washed, a bedding-dusting operation using rotation of a drum and high-temperature hot air is performed before or after a bedding washing course is performed, so that foreign substances, such as dead mite bodies or dust, are dusted from bedding and the effects of washing bedding can be improved. In addition, a section in which the bedding-dusting operation is to be performed, is automatically or manually selected before and after bedding washing is performed so that various operations can be performed and the effects of washing bedding can be improved.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A method of controlling a drying apparatus comprising a drum in which laundry including bedding is accommodated, a motor that rotates the drum, and a blower fan and a heater that supply hot air into the drum, the method comprising:

determining whether a current course is a bedding washing course;

performing a bedding washing operation of removing contamination of the bedding using water and detergent, if it is determined that the current course is the bedding washing course; and performing a bedding-dusting operation of removing foreign substances of the bedding using rotation of the drum and the hot air, wherein the bedding-dusting operation is performed before or after the bedding washing operation is performed.

2. The method of claim 1, wherein the bedding-dusting operation is performed before the water is supplied for the bedding washing operation.

3. The method of claim 1, further comprising performing a drying operation of drying bedding that is wet after the bedding washing operation is performed, using rotation of the drum and the hot air, wherein the bedding-dusting operation is performed after the drying operation is performed.

4. The method of claim 3, wherein the drying operation comprises rotating the drum at a predetermined rotation speed.

5. The method of claim 4, wherein the bedding-dusting operation controls an operation of the motor so as to change the rotation speed of the drum according to predetermined intervals of time.

6. The method of claim 5, wherein the bedding-dusting operation comprises a plurality of sections in which the rotation speed of the drum is changed according to the predetermined intervals of time, and the plurality of sections comprise a first section in which the motor is driven at first revolutions per minute (rpm) and a first operation rate to stir the drum right and left, a second section in which the motor is driven at a second rpm and a second operation rate to stir the drum right and left, and a third section in which the motor is driven at a third rpm and a third operation rate to stir the drum right and left.

7. The method of claim 6, wherein the first section comprises:

(a) rotating the drum in one direction for a fourth time;

(b) after rotating the drum in the one direction, stopping the drum for a fifth time;

(c) if the fifth time elapses, rotating the drum in an opposite direction for the fourth time; and (d) after rotating the drum in the opposite direction, stopping the drum for the fifth time, wherein performing a right and left stirring operation of the drum comprising the operations (a) to (d) is performed for a predetermined first time so that the bedding is capable of being uniformly adhered to inner walls of the drum.

8. The method of claim 6, wherein the second section comprises:

(e) rotating the drum in one direction for a sixth time;

(f) after rotating the drum in the one direction, stopping the drum for a seventh time;

(g) if the seventh time elapses, rotating the drum in an opposite direction for the sixth time; and (h) after rotating the drum in the opposite direction, stopping the drum for the seventh time, wherein performing a right and left stirring operation of the drum comprising the operations (e) to (h) is performed for a predetermined second time so that foreign substances including mites or dust adhered to the bedding are capable of being dusted.

9. The method of claim 6, wherein the third section comprises:

(i) rotating the drum in one direction for an eighth time;

(j) after rotating the drum in the one direction, stopping the drum for a ninth time;

(k) if the ninth time elapses, rotating the drum in an opposite direction for the eighth time; and (l) after rotating the drum in the opposite direction, stopping the drum for the ninth time, wherein performing a right and left stirring operation of the drum comprising the operations (i) to (l) is performed for a predetermined third time so that the bedding is capable of being uniformly distributed into the drum.

10. The method of claim 6, wherein a motor rpm of the first section is greater than a motor rpm of the second section, and a motor rpm of the second section is greater than a motor rpm of the third section.

11. The method of claim 10, wherein the first through third sections further comprise changing the motor rpm when the drum is stirred right and left.

12. The method of claim 6, wherein a motor off time of the first section is shorter than a motor off time of the second section, and a motor off time of the second section is shorter than a motor off time of the third section.

13. The method of claim 12, wherein the first through third sections further comprise changing a motor driving time or a motor stopping time when the drum is stirred right and left.

14. A method of controlling a drying apparatus comprising a drum in which laundry including bedding is accommodated, a motor that rotates the drum, and a blower fan and a heater that supply hot air into the drum, the method comprising:

if a current course is a bedding washing course, performing a bedding washing course comprising a washing operation of removing contamination of the bedding using water and detergent and a drying operation of drying the bedding that is wet in water, using rotation of the drum and hot air; and performing a bedding-dusting operation of removing foreign substances of the bedding that is not wet in water using rotation of the drum and the hot air, wherein the bedding-dusting operation is performed before or after the bedding washing course is performed.

15. A drying apparatus comprising:

a drum in which laundry including bedding is accommodated;

a motor that rotates the drum;

a blower fan that causes air to be introduced into the drum;

a heater that heats air introduced into the drum;

an input unit that selects a bedding washing course for washing of the bedding; and a controller, if the bedding washing course is selected, performing a bedding-dusting operation of removing foreign substances of the bedding by operating the motor, the blower fan, and the heater before water is supplied into the drum and performing a bedding washing operation of removing contamination of the bedding by supplying water into the drum after the bedding-dusting operation is performed.

16. The drying apparatus of claim 15, wherein the controller further performs a drying operation of drying wet bedding after the bedding washing operation is performed.

17. The drying apparatus of claim 16, wherein the controller additionally performs the bedding-dusting operation after the drying operation is performed.

18. The drying apparatus of claim 16, wherein, when the drying operation is performed, the controller drives the motor at predetermined revolutions per minute (rpm) and a predetermined operation rate so as to uniformly maintain a rotation speed of the drum.

19. The drying apparatus of claim 16, wherein, when the bedding-dusting operation is performed, the controller drives the motor at various rpms and various operation rates so as to change a rotation speed of the drum.

20. The drying apparatus of claim 16, further comprising a sensor unit, the sensor unit including a temperature sensor to detect the temperature of air introduced into the drum from the heater, a humidity sensor disposed at a bottom end of a front side of the drum to detect vapor concentration of the laundry, and a water level sensor to detect an amount of water in the drum.

* * * * *